US007111687B2

(12) United States Patent
Donald et al.

(10) Patent No.: US 7,111,687 B2
(45) **Date of Patent: *Sep. 26, 2006**

(54) RECOVERY OF PRODUCTION FLUIDS FROM AN OIL OR GAS WELL

(75) Inventors: Ian Donald, Aberdeenshire (GB); James Steele, Aberdeen (GB); John Reid, Dundee (GB)

(73) Assignee: DES Enhanced Recovery Limited, Aberdeen (GB)

( * ) Notice: Subject to any disclaimer, the term of this patent is extended or adjusted under 35 U.S.C. 154(b) by 177 days.

This patent is subject to a terminal disclaimer.

(21) Appl. No.: 10/651,703

(22) Filed: Aug. 29, 2003

(65) Prior Publication Data

US 2005/0028984 A1 Feb. 10, 2005

Related U.S. Application Data

(63) Continuation-in-part of application No. 10/009,991, filed as application No. PCT/GB00/01785 on May 15, 2000, now Pat. No. 6,637,514.

(51) Int. Cl.
*E21B 33/035* (2006.01)

(52) U.S. Cl. ..... 166/368; 166/75.12; 166/88.4; 166/95.1; 166/97.1

(58) Field of Classification Search ..... 166/368, 166/88.4, 95.1, 97.1, 97.5, 75.12
See application file for complete search history.

(56) References Cited

U.S. PATENT DOCUMENTS

| | | | |
|---|---|---|---|
| 3,101,118 | A | 8/1963 | Culver et al. |
| 4,260,022 | A | 4/1981 | Van Bilderbeek |
| 4,405,016 | A | 9/1983 | Best |
| 4,502,534 | A | 3/1985 | Roche et al. |
| 4,607,701 | A | 8/1986 | Gundersen |
| 4,848,473 | A | 7/1989 | Lochte |
| 4,874,008 | A | 10/1989 | Lawson |
| 5,010,956 | A | 4/1991 | Bednar |
| 5,143,158 | A | 9/1992 | Watkins et al. |
| 5,535,826 | A | 7/1996 | Brown et al. |
| 5,544,707 | A | 8/1996 | Hopper et al. |
| 5,868,204 | A | 2/1999 | Pritchett et al. |
| 5,971,077 | A | 10/1999 | Lilley |
| 5,992,527 | A | 11/1999 | Garnham et al. |
| 6,050,339 | A | 4/2000 | Milberger |
| 6,145,596 | A | 11/2000 | Dallas |
| 6,227,300 | B1 | 5/2001 | Cunningham et al. |
| 6,460,621 | B1 | 10/2002 | Fenton et al. |

FOREIGN PATENT DOCUMENTS

| | | |
|---|---|---|
| EP | 0719905 A1 | 7/1996 |
| EP | 0841464 | 5/1998 |
| GB | 2197675 | 5/1988 |
| GB | 2319795 | 6/1998 |

(Continued)

*Primary Examiner*—Hoang Dang
(74) *Attorney, Agent, or Firm*—Drinker Biddle & Reath LLP

(57) ABSTRACT

A method and assembly for recovering fluids from, or injecting fluids into, a well having a christmas tree; the fluids typically flow between first and second flowpaths in a continuous path. The assembly may be located within the main bore, or a side passage of the christmas tree. Embodiments of the invention allow the fluids to be fed to a processing apparatus, (e.g. a pump or chemical injection apparatus) for treatment, before being returned to the christmas tree. Optionally, the assembly may include a pump located inside the christmas tree body.

28 Claims, 36 Drawing Sheets

FOREIGN PATENT DOCUMENTS

| | | |
|---|---|---|
| GB | 2346630 | 8/2000 |
| WO | WO 99/28593 | 6/1999 |
| WO | WO 00/70185 | 11/2000 |

Section B-B

PRODUCTION WELL.

INJECTION WELL.

TYPICAL SECTION

RECOVERY OF PRODUCTION FLUIDS FROM AN OIL OR GAS WELL

RELATED APPLICATION

This application is a continuation-in-part of U.S. patent application Ser. No. 10,009,991, filed Jul. 16, 2002 now U.S. Pat. No. 6,637,514, which is the national phase of PCT Application No. PCT/GB00/01785, filed May 15, 2000 and which claims priority from UK Application Serial No. 9911146.0, filed May 14, 2000. Priority is hereby claimed to each of the above applications, and those applications are incorporated herein by reference in their entirety. This application also claims priority from UK Patent Application No. 0312543.2, filed May 31, 2003, the disclosure of which is included herein by reference in its entirety.

FIELD OF THE INVENTION

The present invention relates to the recovery of production fluids from an oil or gas well having a christmas tree.

BACKGROUND OF THE INVENTION

Christmas trees are well known in the art of oil and gas wells, and generally comprise an assembly of pipes, valves and fittings installed in a wellhead after completion of drilling and installation of the production tubing to control the flow of oil and gas from the well. Subsea christmas trees typically have at least two bores one of which communicates with the production tubing (the production bore), and the other of which communicates with the annulus (the annulus bore). The annulus bore and production bore are typically side by side, but various different designs of christmas tree have different configurations (i.e. concentric bores, side by side bores, and more than two bores etc).

Typical designs of christmas tree have a side outlet to the production bore closed by a production wing valve for removal of production fluids from the production bore. The top of the production bore and the top of the annulus bore are usually capped by a christmas tree cap which typically seals off the various bores in the christmas tree, and provides hydraulic channels for operation of the various valves in the christmas tree by means of intervention equipment, or remotely from an offshore installation.

In low pressure wells, it is generally desirable to boost the pressure of the production fluids flowing through the production bore, and this is typically done by installing a pump or similar apparatus after the production wing valve in a pipeline or similar leading from the side outlet of the christmas tree. However, installing such a pump in an active well is a difficult operation, for which production must cease for some time until the pipeline is cut, the pump installed, and the pipeline resealed and tested for integrity.

A further alternative is to pressure boost the production fluids by installing a pump from a rig, but this requires a well intervention from the rig, which can be even more expensive than breaking the subsea or seabed pipework.

According to the present invention there is provided a method of recovering production fluids from a well having a tree, the tree having a first flowpath and a second flowpath, the method comprising diverting fluids from a first portion of the first flowpath to the second flowpath, and diverting the fluids from the second flowpath back to a second portion of the first flowpath, and thereafter recovering fluids from the outlet of the first flowpath.

Preferably the first flowpath is a production bore or production line, and the first portion of it is typically a lower part near to the wellhead. The second portion of the first flowpath is typically a downstream portion of the bore or line adjacent a branch outlet, although the first or second portions can be in the branch or outlet of the first flowpath.

The diversion of fluids from the first flowpath allows the treatment of the fluids (e.g. with chemicals) or pressure boosting for more efficient recovery before re-entry into the first flowpath.

Optionally the second flowpath is an annulus bore, or a conduit inserted into the first flowpath. Other types of bore may optionally be used for the second flowpath instead of an annulus bore.

Typically the flow diversion from the first flowpath to the second flowpath is achieved by a cap on the tree. Optionally, the cap contains a pump or treatment apparatus, but this can be provided separately, or in another part of the apparatus, and in most embodiments of this type, flow will be diverted via the cap to the pump etc and returned to the cap by way of tubing. A connection typically in the form of a conduit is typically provided to transfer fluids between the first and second flowpaths.

Typically, the diverter assembly can be formed from high grade steels or other metals, using e.g. resilient or inflatable sealing means as required.

The assembly may include outlets for the first and second flowpaths, for diversion of the fluids to a pump or treatment assembly.

The assembly preferably comprises a conduit capable of insertion into the first flowpath, the assembly having sealing means capable of sealing the conduit against the wall of the production bore. The conduit may provide a flow diverter through its central bore which typically leads to a christmas tree cap and the pump mentioned previously. The seal effected between the conduit and the first flowpath prevents fluid from the first flowpath entering the annulus between the conduit and the production bore except as described hereinafter. After passing through a typical booster pump, squeeze or scale chemical treatment apparatus, the fluid is diverted into the second flowpath and from there to a crossover back to the first flowpath and first flowpath outlet.

The assembly and method are typically suited for subsea production wells in normal mode or during well testing, but can also be used in subsea water injection wells, land based oil production injection wells, and geothermal wells.

The pump can be powered by high pressure water or by electricity which can be supplied direct from a fixed or floating offshore installation, or from a tethered buoy arrangement, or by high pressure gas from a local source.

The cap preferably seals within christmas tree bores above the upper master valve. Seals between the cap and bores of the tree are optionally O-ring, inflatable, or preferably metal-to-metal seals. The cap can be retro-fitted very cost effectively with no disruption to existing pipework and minimal impact on control systems already in place.

The typical design of the flow diverters within the cap can vary with the design of tree, the number, size, and configuration of the diverter channels being matched with the production and annulus bores, and others as the case may be. This provides a way to isolate the pump from the production bore if needed, and also provides a bypass loop.

The cap is typically capable of retro-fitting to existing trees, and many include equivalent hydraulic fluid conduits for control of tree valves, and which match and co-operate with the conduits or other control elements of the tree to which the cap is being fitted.

In most preferred embodiments, the cap has outlets for production and annulus flow paths for diversion of fluids away from the cap.

The present application also relates to an improvement to this technology, in which a pump is disposed within a conduit of a tree, and typically within a fluid diverter assembly.

SUMMARY OF THE INVENTION

In accordance with the invention there is also provided a flow diverter assembly for a tree, the flow diverter assembly having a pump adapted to fit within a bore of the tree.

The tree is typically a subsea tree, such as a christmas tree, typically on a subsea well, but a topside tree could also be appropriate. Horizontal or vertical trees are equally suitable for use of the invention.

The flow diverter typically incorporates diverter means to divert fluids flowing through the production bore of the tree from a first portion of the production bore, through the pump, and back to a second portion of the production bore for recovery therefrom via an outlet, which is typically the production wing valve.

The first portion from which the fluids are initially diverted is typically the production bore or line of the well, and flow from this portion is typically diverted into a diverter conduit sealed within the production bore. Fluid is typically diverted through the bore of the diverter conduit, and after passing therethrough, and exiting the bore of the diverter conduit, typically passes through the annulus created between the diverter conduit and the production bore or line. At some point on the diverted fluid path, the fluid passes through the pump internally of the tree, thereby minimising the external profile of the tree, and reducing the chances of damage to the pump.

The pump is typically powered by a motor, and the type of motor can be chosen from several different forms. In some embodiments of the invention, a hydraulic turbine or moineau motor can be driven by any well-known method, for example an electro-hydraulic power pack or similar power source, and can be connected, either directly or indirectly, to the pump. In certain other embodiments, the motor can be an electric motor, powered by a local power source or by a remote power source.

Certain embodiments of the present invention allow the construction of wellhead assemblies that can drive the fluid flow in different directions, simply by reversing the flow of the pump, although in some embodiments valves may need to be changed (e.g. reversed) depending on the design of the embodiment.

The flow diverter assembly typically includes a tree cap that can be retrofitted to existing designs of tree, and can integrally contain the pump and/or the motor to drive it.

The flow diverter preferably also comprises a conduit capable of insertion into the production bore, and may have sealing means capable of sealing the conduit against the wall of the production bore. The flow diverter typically seals within christmas tree bores above an upper master valve in a conventional tree, or in the tubing hangar of a horizontal tree, and seals can be optionally O-ring, inflatable, elastomeric or metal to metal seals. The cap or other parts of the flow diverter can comprise hydraulic fluid conduits. The pump can optionally be sealed within the conduit.

The present invention also provides a method of recovering productions fluids from a well having a tree, the tree having an integral pump located in a bore of the tree, and the method comprising diverting fluids from a first portion of a production bore of the well through the pump and into a second portion of the production bore.

BRIEF DESCRIPTION OF THE DRAWINGS

Embodiments of the invention will now be described by way of example and with reference to the accompanying drawings in which.

DETAILED DISCUSSION OF THE PREFERRED EMBODIMENTS

Figure 1:
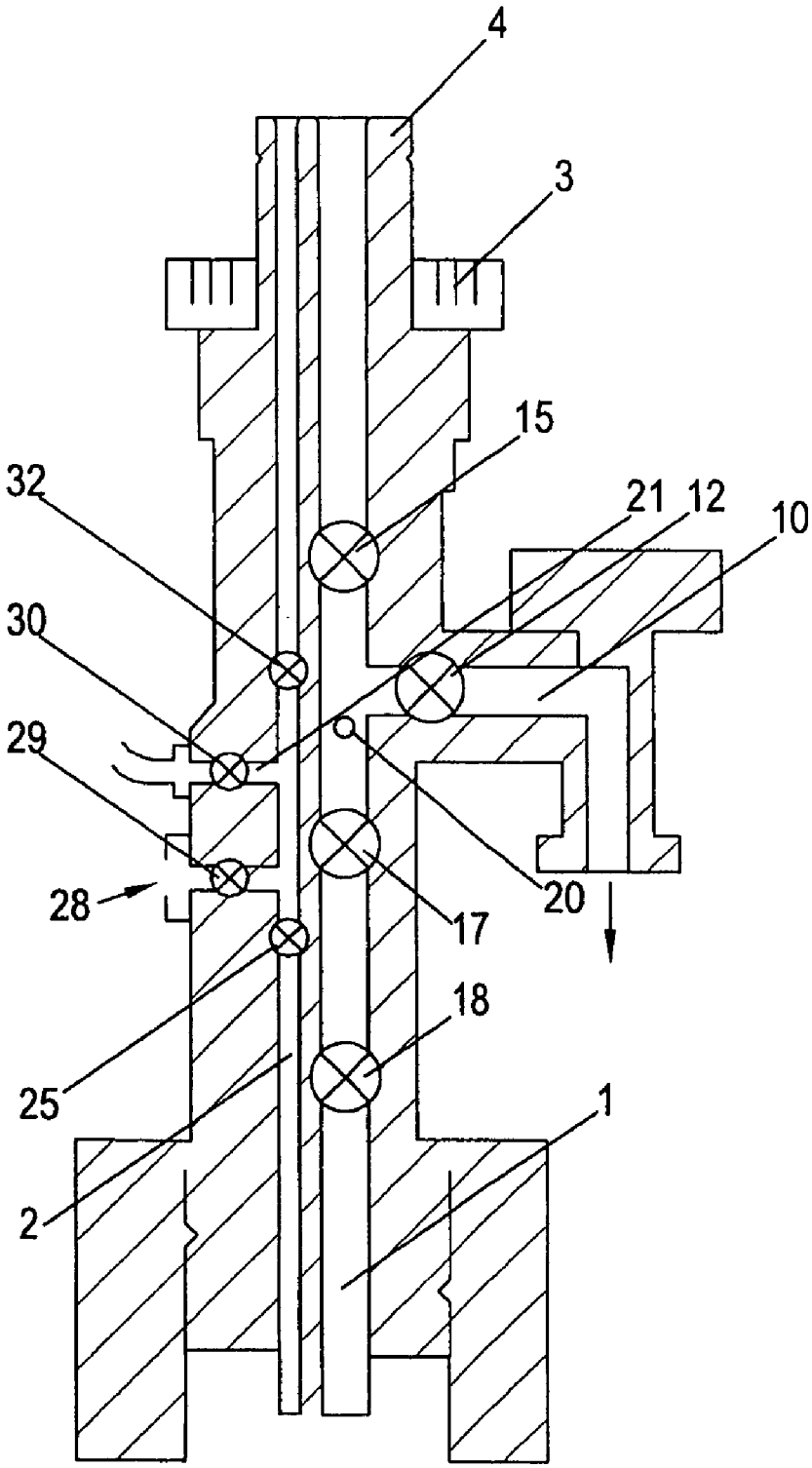
FIG. 1 is a side sectional view of a typical production tree.

Referring now to the drawings, a typical production tree on an offshore oil or gas wellhead comprises a production bore 1 leading from production tubing (not shown) and carrying production fluids from a perforated region of the production casing in a reservoir (not shown). An annulus bore 2 leads to the annulus between the casing and the production tubing and a christmas tree cap 4 which seals off the production and annulus bores 1, 2, and provides a number of hydraulic control channels 3 by which a remote platform or intervention vessel can communicate with and operate the valves in the christmas tree. The cap 4 is removable from the christmas tree in order to expose the production and annulus bores in the event that intervention is required and tools need to be inserted into the production or annulus bores 1, 2.

The flow of fluids through the production and annulus bores is governed by various valves shown in the typical tree of FIG. 1. The production bore 1 has a branch 10 which is closed by a production wing valve (PWV) 12. A production swab valve (PSV) 15 closes the production bore 1 above the branch 10 and PWV 12. Two lower valves UPMV 17 and LPMV 18 (which is optional) close the production bore 1 below the branch 10 and PWV 12. Between UPMV 17 and PSV 15, a crossover port (XOV) 20 is provided in the production bore 1 which connects to a the crossover port (XOV) 21 in annulus bore 2.

The annulus bore is closed by an annulus master valve (AMV) 25 below an annulus outlet 28 controlled by an annulus wing valve (AWV) 29, itself below crossover port 21. The crossover port 21 is closed by crossover valve 30. An annulus swab valve 32 located above the crossover port 21 closes the upper end of the annulus bore 2.

All valves in the tree are typically hydraulically controlled (with the exception of LPMV 18 which may be mechanically controlled) by means of hydraulic control channels 3 passing through the cap 4 and the body of the tool or via hoses as required, in response to signals generated from the surface or from an intervention vessel.

When production fluids are to be recovered from the production bore 1, LPMV 18 and UPMV 17 are opened, PSV 15 is closed, and PWV 12 is opened to open the branch 10 which leads to the pipeline (not shown). PSV 15 and ASV 32 are only opened if intervention is required.

Figure 2:
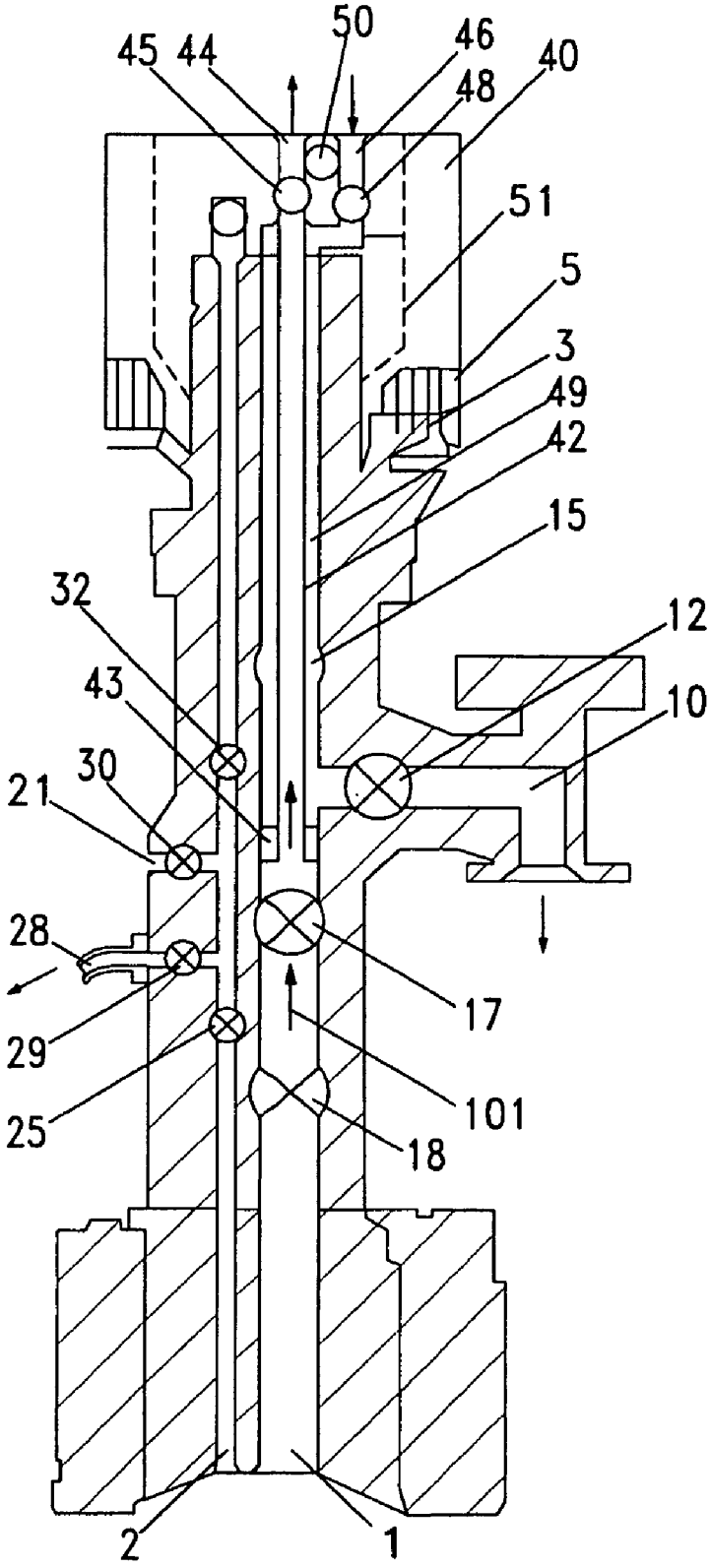
FIG. 2 is a side view of the FIG. 1 tree with a diverter cap in place.

Referring now to FIG. 2, a wellhead cap 40 has a hollow conduit 42 with metal, inflatable or resilient seals 43 at its lower end which can seal the outside of the conduit 42 against the inside walls of the production bore 1, diverting production fluids flowing up the production bore 1 in the direction of arrow 101 into the hollow bore of the conduit 42 and from there to the cap 40. The bore of conduit 42 can be closed by a cap service valve (CSV) 45 which is normally open but can close off an outlet 44 of the hollow bore of the conduit 42. Outlet 44 leads via tubing 206 to processing apparatus 200 (see FIG. 17). Many different types of processing apparatus could be used here. For example, the processing apparatus 200 could comprise a pump or process fluid turbine, for boosting the pressure of the fluid. Alternatively, or additionally, the processing apparatus could inject gas or steam into the well fluids. The injection of gas could be advantageous, as it would give the fluids "lift", making them easier to pump. The addition of steam has the effect of adding energy to the fluids. Specific embodiments of the invention which involve gas injection will be described below with reference to FIGS. 21 to 23.

The processing apparatus 200 could also enable chemicals to be added to the well fluids, e.g. viscosity moderators, which thin out the produced fluids, making them easier to pump, or pipe skin friction moderators, which minimise the friction between the fluids and the pipes. The chemicals/injected materials could be added via one or more additional input conduits 202.

The processing apparatus 200 could also comprise a fluid riser, which could provide an alternative route to the surface for the produced fluids. This could be very useful if, for example, the export line 10 becomes blocked.

Alternatively, processing apparatus 200 could comprise separation equipment e.g. for separating gas, water, sand/debris and/or hydrocarbons. The separated component(s) could be siphoned off via one or more additional process conduits 204.

The processing apparatus 200 could alternatively or additionally include measurement apparatus, e.g. for measuring the temperature/flow rate/constitution/consistency, etc. The temperature could then be compared to temperature readings taken from the bottom of the well to calculate the temperature change in the produced fluids.

After treatment by the processing apparatus 200 the production fluids are returned via tubing 208 to the production inlet 46 of the cap 40 which leads via cap flowline valve (CFV) 48 to the annulus between the conduit 42 and the production bore 1. Production fluids flowing into the inlet 46 and through valve 48 flow down the annulus 49 through open PSV 15 and diverted by seals 43 out through branch 10 since PWV 12 is open. Production fluids can thereby be recovered via this diversion. The conduit bore and the inlet 46 can also have an optional crossover valve (COV) designated 50, and a tree cap adapter 51 in order to adapt the flow diverter channels in the tree cap 40 to a particular design of tree head. Control channels 3 are mated with a cap controlling adapter 5 in order to allow continuity of electrical or hydraulic control functions from surface or an intervention vessel.

This embodiment therefore provides a fluid diverter for use with a wellhead tree comprising a thin walled diverter conduit and a seal stack element connected to a modified christmas tree cap, sealing inside the production bore of the christmas tree typically above the hydraulic master valve, diverting flow through the diverter conduit and the top of the christmas tree cap and tree cap valves to typically a pressure boosting device or chemical treatment apparatus, with the return flow routed via the tree cap to the annular space between the diverter conduit and the existing tree bore through the wing valve to the flowline.

Figure 3A:
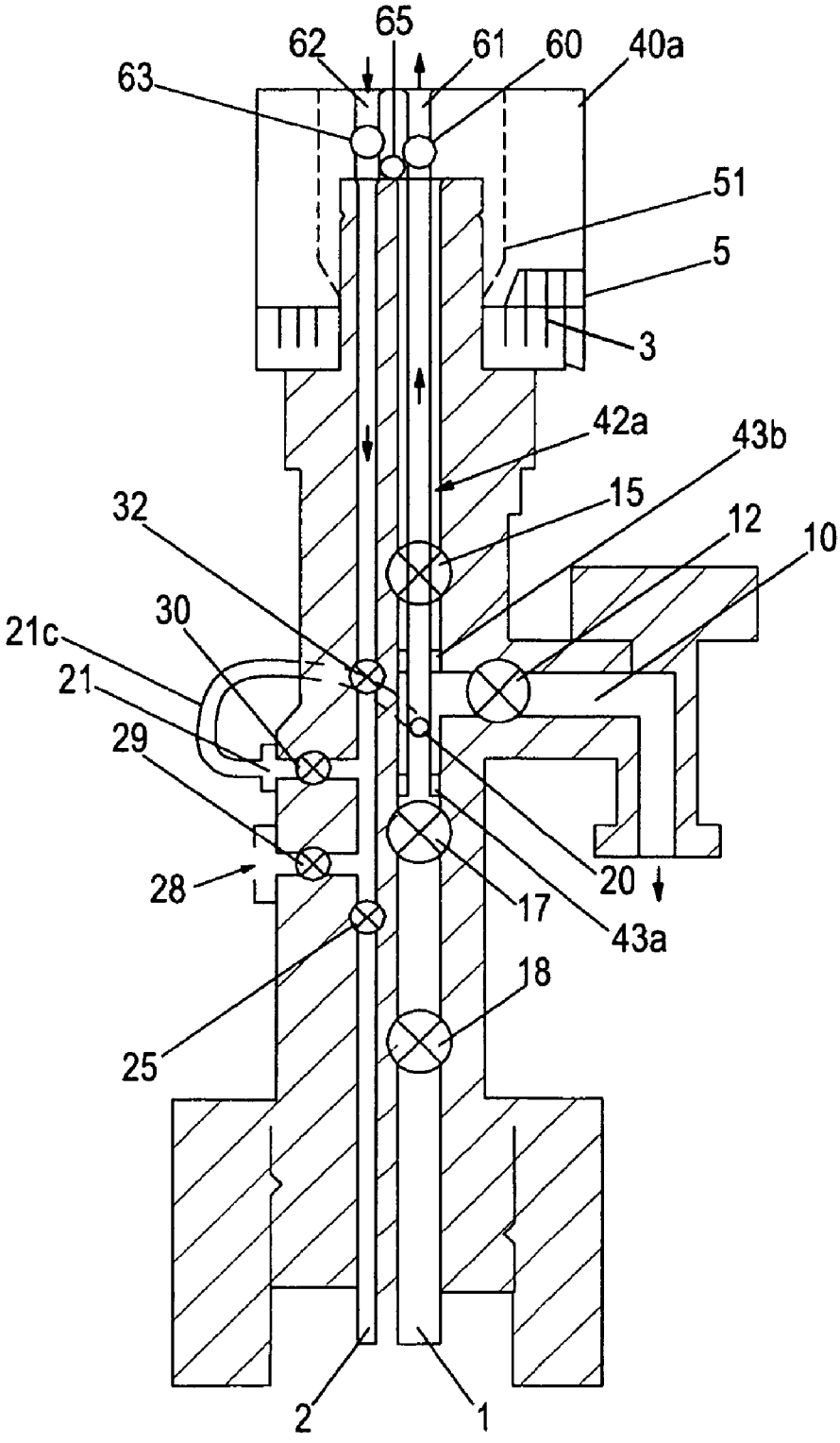
FIG. 3*a* is a view of the FIG. 1 tree with a second embodiment of a cap in place.

Referring to FIG. 3*a*, a further embodiment of a cap 40*a* has a large diameter conduit 42*a* extending through the open PSV 15 and terminating in the production bore 1 having seal stack 43*a* below the branch 10, and a further seal stack 43*b* sealing the bore of the conduit 42*a* to the inside of the production bore 1 above the branch 10, leaving an annulus between the conduit 42*a* and bore 1. Seals 43*a* and 43*b* are disposed on an area of the conduit 42*a* with reduced diameter in the region of the branch 10. Seals 43*a* and 43*b* are also disposed on either side of the crossover port 20 communicating via channel 21*c* to the crossover port 21 of the annulus bore 2. In the cap 40*a*, the conduit 42*a* is closed by cap service valve (CSV) 60 which is normally open to allow flow of production fluids from the production bore 1 via the central bore of the conduit 42 through the outlet 61 to the pump or chemical treatment apparatus. The treated or pressurised production fluid is returned from the pump or treatment apparatus to inlet 62 in the annulus bore 2 which is controlled by cap flowline valve (CFV) 63. Annulus swab valve 32 is normally held open, annulus master valve 25 and annulus wing valve 29 are normally closed, and crossover valve 30 is normally open to allow production fluids to pass through crossover channel 21*c* into crossover port 20 between the seals 43*a* and 43*b* in the production bore 1, and thereafter through the open PWV 12 into the bore 10 for recovery to the pipeline. A crossover valve 65 is provided between the conduit bore 42*a* and the annular bore 2 in order to bypass the pump or treatment apparatus if desired. Normally the crossover valve 65 is maintained closed.

This embodiment maintains a fairly wide bore for more efficient recovery of fluids at relatively high pressure, thereby reducing pressure drops across the apparatus.

This embodiment therefore provides a fluid diverter for use with a wellhead tree comprising a thin walled diverter with two seal stack elements, connected to a tree cap, which straddles the crossover valve outlet and flowline outlet (which are approximately in the same horizontal plane), diverting flow through the centre of the diverter conduit and the top of the tree cap to pressure boosting or chemical treatment apparatus etc, with the return flow routed via the tree cap and annulus bore (or annulus flow path in concentric trees) and the crossover loop and crossover outlet, to the annular space between the straddle and the existing xmas tree bore through the wing valve to the flowline.

Figure 3B:
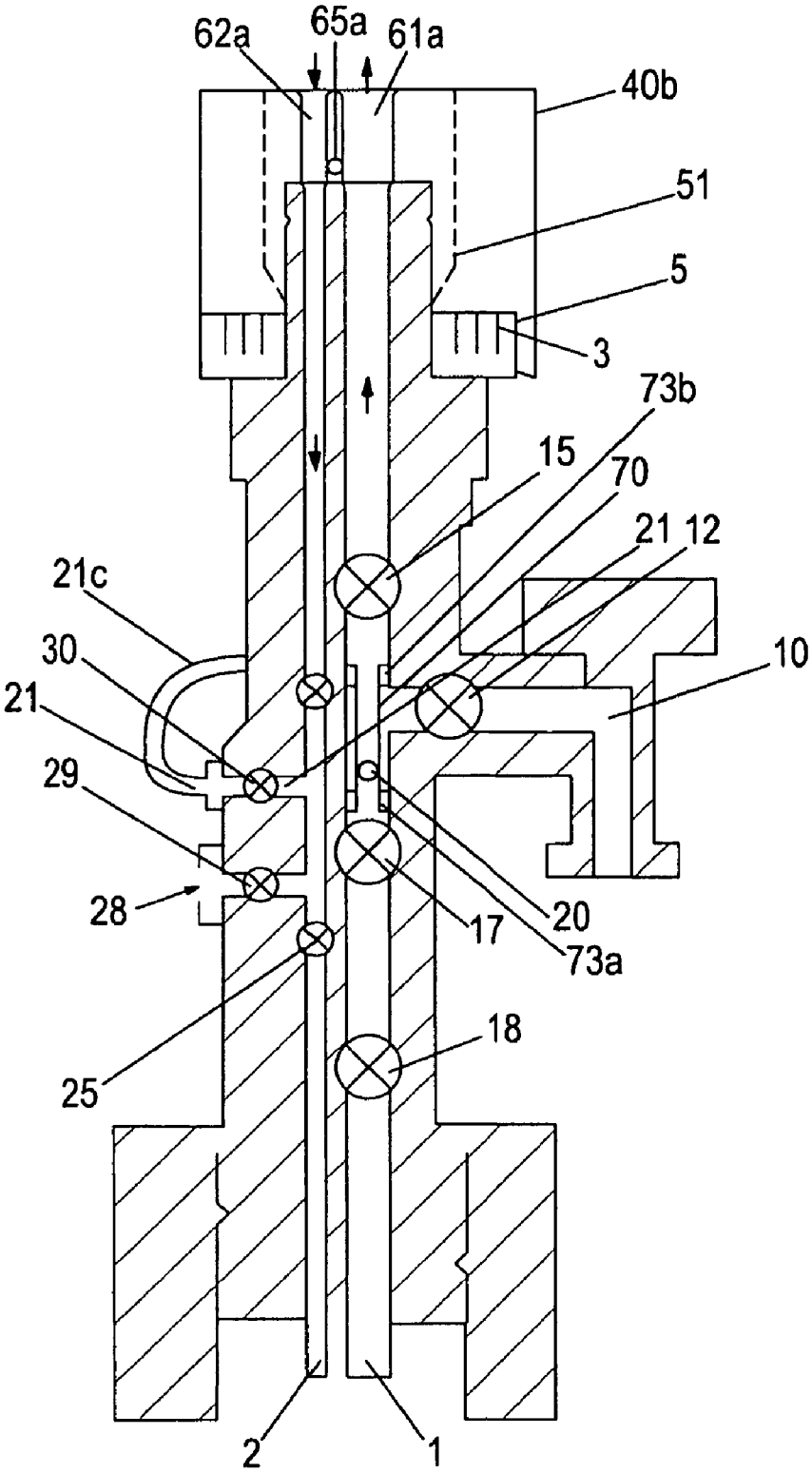
FIG. 3*b* is a view of the FIG. 1 tree with a third embodiment of a cap in place.

FIG. 3*b* shows a simplified version of a similar embodiment, in which the conduit 42*a* is replaced by a production bore straddle 70 having seals 73*a* and 73*b* having the same position and function as seals 43*a* and 43*b* described with reference to the FIG. 3*a* embodiment. In the FIG. 3*b* embodiment, production fluids passing through open LPMV 18 and UPMV 17 are diverted through the straddle 70, and through open PSV 111 and outlet 61*a*. From there, the production fluids are treated or pressurised as the case may be and returned to inlet 62*a* where they are diverted as previously described through channel 21*c* and crossover port 20 into the annulus between the straddle 70 and the production bore 1, from where they can pass through the open valve PWV 12 into the branch 10 for recovery to a pipeline.

This embodiment therefore provides a fluid diverter for use with a wellhead tree which is not connected to the tree cap by a thin walled conduit, but is anchored in the tree bore, and which allows full bore flow above the "straddle" portion, but routes flow through the crossover and will allow a swab valve (PSV) to function normally.

Figure 4A:
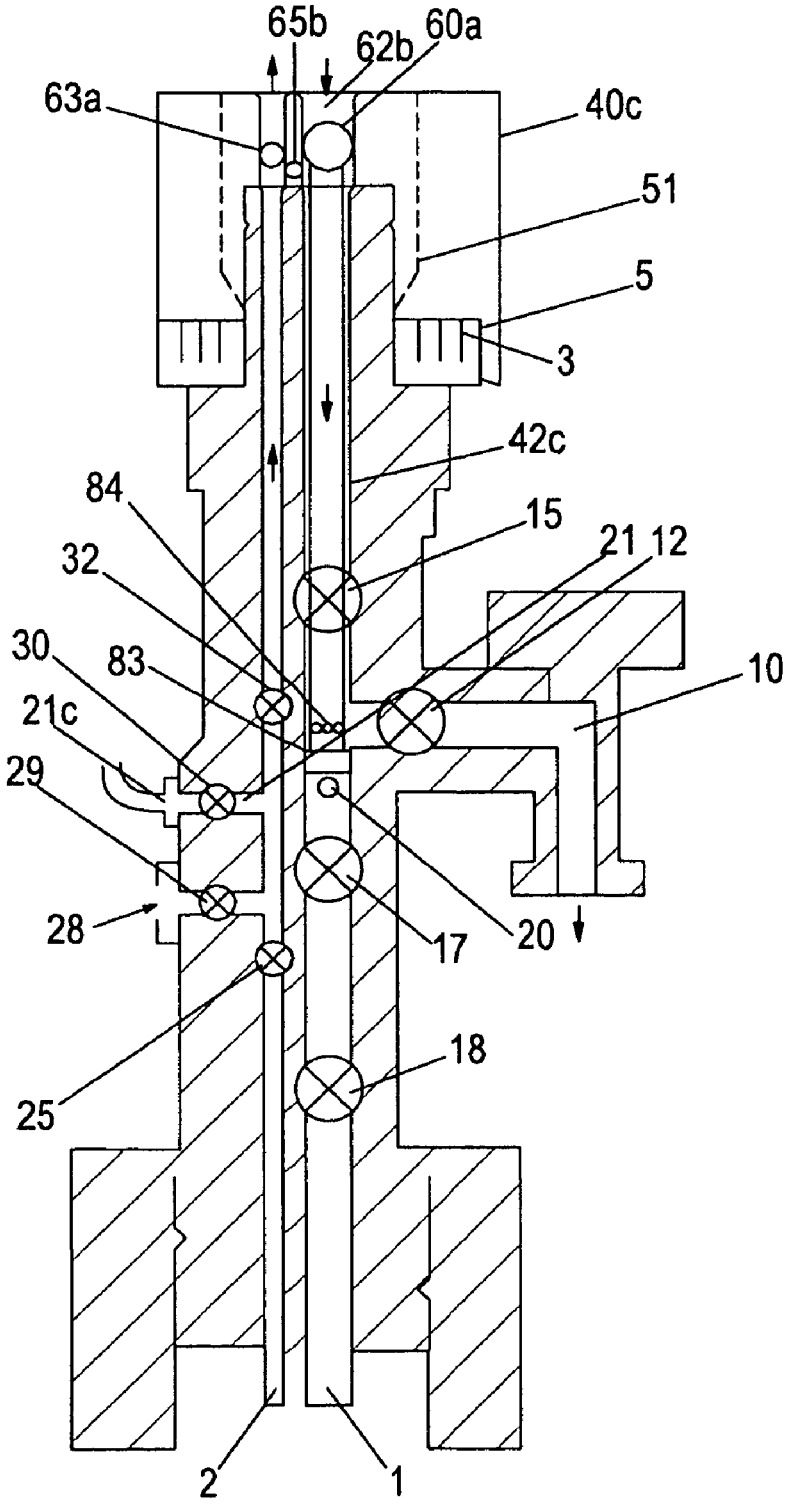
FIG. 4*a* is a view of the FIG. 1 tree with a fourth embodiment of a cap in place.

The FIG. 4*a* embodiment has a different design of cap 40*c* with a wide bore conduit 42*c* extending down the production bore 1 as previously described. The conduit 42*c* substantially fills the production bore 1, and at its distal end seals the production bore at 83 just above the crossover port 20, and below the branch 10. The PSV 15 is, as before, maintained open by the conduit 42*c*, and perforations 84 at the lower end of the conduit are provided in the vicinity of the branch 10. In the FIG. 4*a* embodiment, LPMV 18 and UPMV 17 are held open and production fluids in the production bore 1 are diverted by the seal 83 through the XOV port 20 and channel 21*c* into the XOV port 21 of the annulus bore 2. XOV valve 30 into the annulus bore is open, AMV 25 is closed as is AWV 29. ASV 32 is opened and production fluids passing through the crossover into the annulus bore 2 are diverted up through the annulus bore 2, through the open service valve (CSV) 63*a* through the chemical treatment or pump as required and back into the inlet 62*b* of the production bore 1. Cap flowline valve (CFV) 60*a* is open allowing the production fluids to flow into the bore of the conduit 42*c* and out of the apertures 84, through open PWV 12 and into the branch 10 for recovery to the pipeline. Crossover valve 65*b* is provided between the production bore 1 and annulus bore 2 in order to bypass the chemical treatment or pump as required.

This embodiment therefore provides a fluid diverter for use with a wellhead tree comprising a thin walled conduit connected to a tree cap, with one seal stack element, which is plugged at the bottom, sealing in the production bore above the hydraulic master valve and crossover outlet (where the crossover outlet is below the horizontal plane of the flowline outlet), diverting flow through the crossover outlet and annulus bore (or annulus flow path in concentric trees) through the top of the tree cap to a treatment or booster with the return flow routed via the tree cap through the bore of the conduit 42, exiting therefrom through perforations 84 near the plugged end, and passing through the annular space between the perforated end of the conduit and the existing tree bore to the production flowline.

Figure 4B:
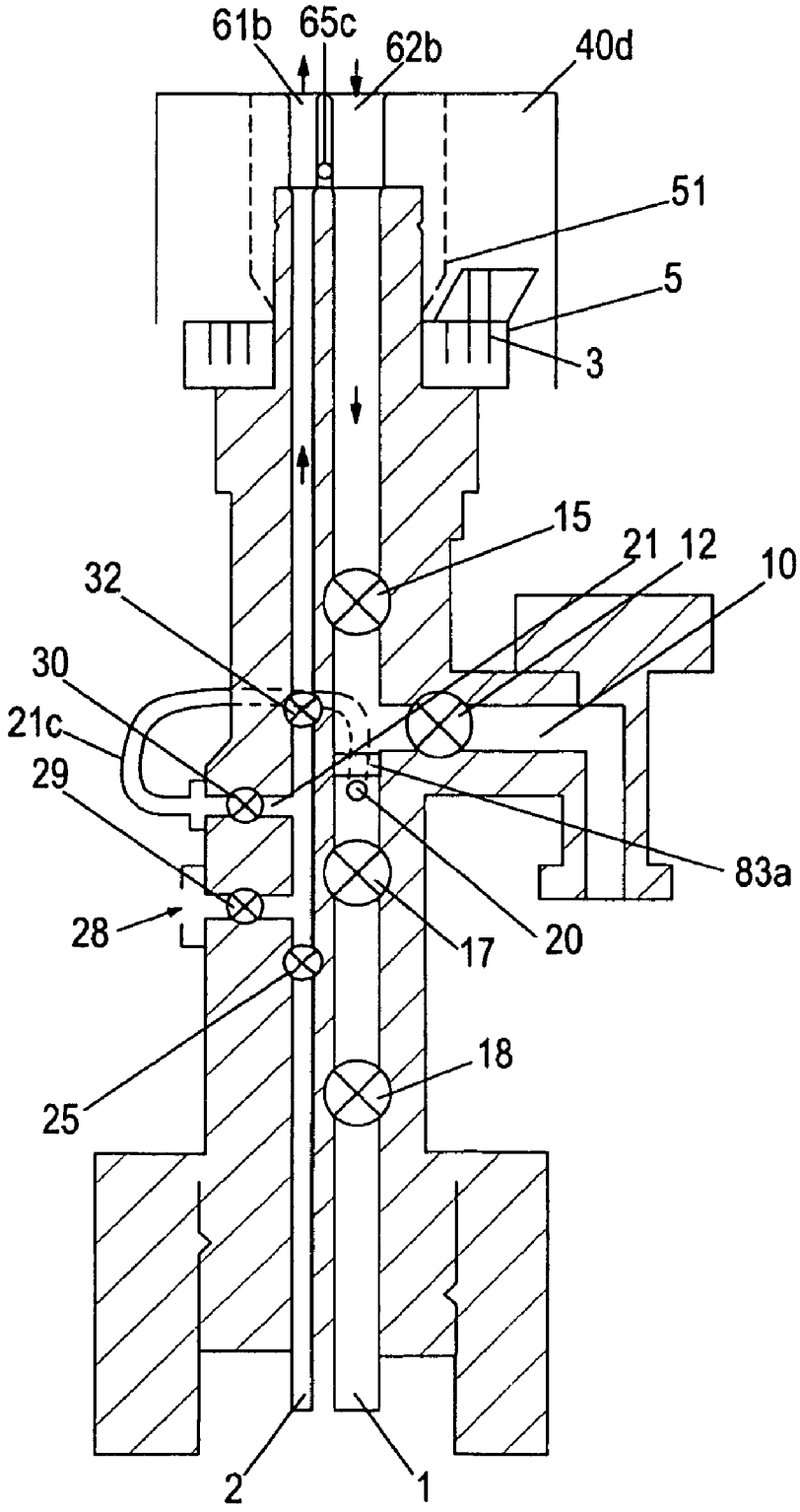
FIG. 4*b* is a side view of the FIG. 1 tree with a fifth embodiment of a cap in place.

Referring now to FIG. 4*b*, a modified embodiment dispenses with the conduit 42*c* of the FIG. 4*a* embodiment, and simply provides a seal 83*a* above the XOV port 20 and below the branch 10. LPMV 18 and UPMV 17 are opened, and the seal 83*a* diverts production fluids in the production bore 1 through the crossover port 20, crossover channel 21*c*, crossover valve 30 and crossover port 21 into the annulus bore 2. AMV 25 and AWV 29 are closed, ASV 32 is opened allowing production fluids to flow up the annulus bore 2 through outlet 61*b* to the chemical treatment apparatus or to the pump (or both) as required, and is returned to the inlet 62*b* of the production tubing 1 where it flows down through open PSV 15, and is diverted by seal 83*a* into branch 10 and through open PWV 12 into the pipeline for recovery.

This embodiment provides a fluid diverter for use with a wellhead tree which is not connected to the tree cap by a thin walled conduit, but is anchored in the tree bore and which routes the flow through the crossover and allows full bore flow for the return flow, and will allow the swab valve to function normally.

Figure 5:
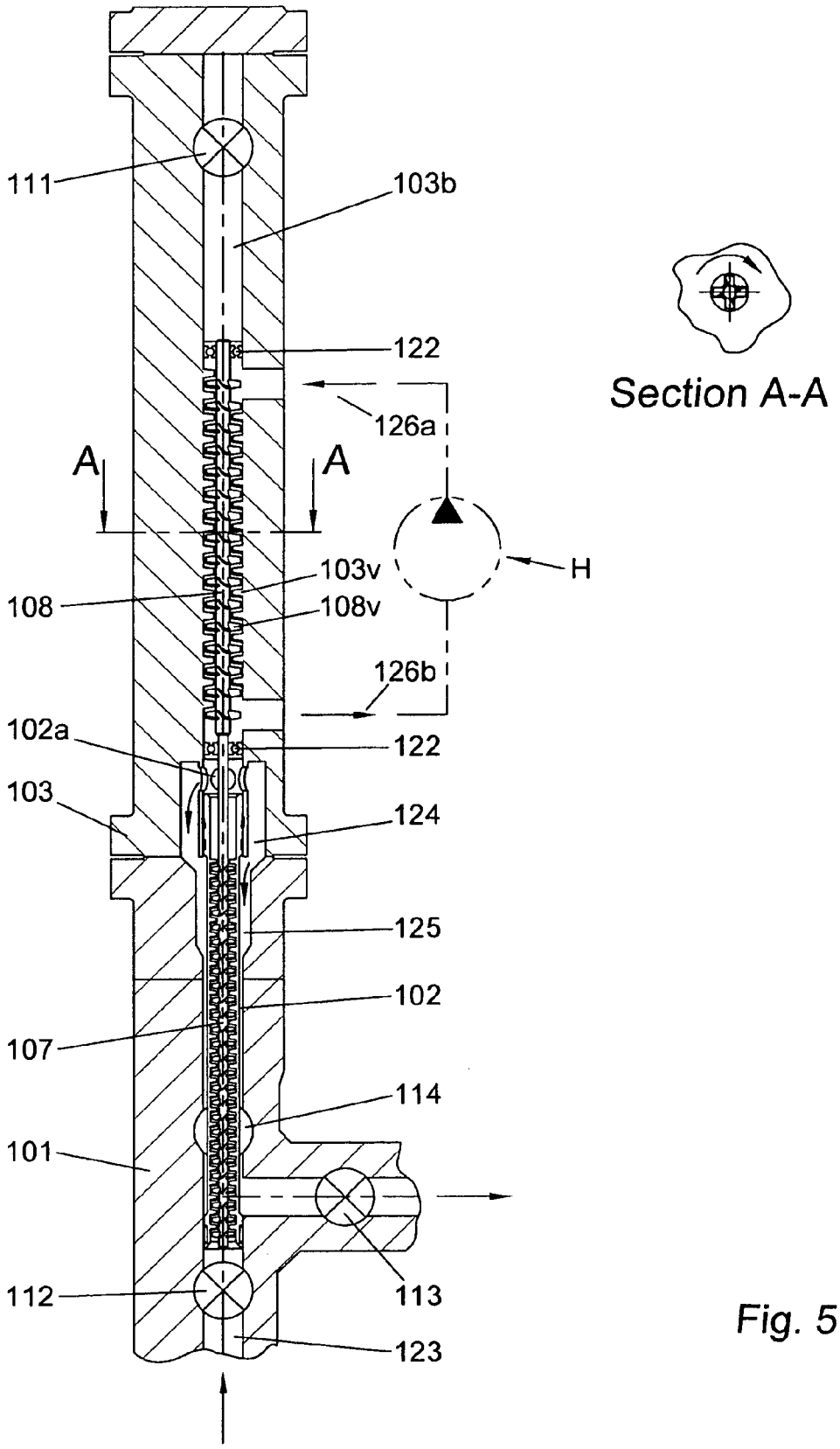
FIG. 5 shows a side view of a first embodiment of a flow diverter assembly.

FIG. 5 shows a subsea tree 101 having a production bore 123 for the recovery of production fluids from the well. The tree 101 has a cap body 103 that has a central bore 103*b*, and which is attached to the tree 101 so that the bore 103*b* of the cap body 103 is aligned with the production bore 123 of the tree.

Flow of production fluids through the production bore 123 is controlled by the tree master valve 112, which is normally open, and the tree swab valve 114, which is normally closed during the production phase of the well, so as to divert fluids flowing through the production bore 123 and the tree master valve 112, through the production wing valve 113 in the production branch, and to a production line for recovery as is conventional in the art.

In the embodiment of the invention shown in FIG. 5, the bore 103*b* of the cap body 103 contains a turbine or turbine motor 108 mounted on a shaft that is journalled on bearings 122. The shaft extends continuously through the lower part of the cap body bore 103*b* and into the production bore 123 at which point, a turbine pump, centrifugal pump or, as shown here a turbine pump 107 is mounted on the same shaft. The turbine pump 107 is housed within a conduit 102.

The turbine motor 108 is configured with inter-collating vanes 108*v* and 103*v* on the shaft and side walls of the bore 103*b* respectively, so that passage of fluid past the vanes in the direction of the arrows 126*a* and 126*b* turns the shaft of the turbine motor 108, and thereby turns the vanes of the turbine pump 107, to which it is directly connected.

The bore of the conduit 102 housing the turbine pump 107 is open to the production bore 123 at its lower end, but there is a seal between the outer face of the conduit 102 and the inner face of the production bore 123 at that lower end, between the tree master valve 112 and the production wing branch, so that all production fluid passing through the production bore 123 is diverted into the bore of the conduit 102. The seal is typically an elastomeric or a metal to metal seal.

The upper end of the conduit 102 is sealed in a similar fashion to the inner surface of the cap body bore 103*b*, at a lower end thereof, but the conduit 102 has apertures 102*a* allowing fluid communication between the interior of the conduit 102, and the annulus 124, 125 formed between the conduit 102 and the bore of the tree.

The turbine motor 108 is driven by fluid propelled by a hydraulic power pack H which typically flows in the direction of arrows 126*a* and 126*b* so that fluid forced down the bore 103*b* of the cap turns the vanes 108*v* of the turbine motor 108 relative to the vanes 103*v* of the bore, thereby turning the shaft and the turbine pump 107. These actions draw fluid from the production bore 123 up through the inside of the conduit 102 and expels the fluid through the apertures 102*a*, into the annulus 124, 125 of the production bore. Since the conduit 102 is sealed to the bore above the apertures 102*a*, and below the production wing branch at the lower end of the conduit 102, the fluid flowing into the annulus 124 is diverted through the annulus 125 and into the production wing through the production wing valve 113 and can be recovered by normal means.

Another benefit of the present embodiment is that the direction of flow of the hydraulic power pack H can be reversed from the configuration shown in FIG. 5, and in such case the fluid flow would be in the reverse direction from that shown by the arrows in FIG. 5, which would allow the re-injection of fluid from the production wing valve 113, through the annulus 125, 124 aperture 102*a*, conduit 102 and into the production bore 123, all powered by means of the pump 107 and motor 108 operating in reverse. This can allow water injection or injection of other chemicals or substances into all kinds of wells.

In the FIG. 5 embodiment, any suitable turbine or moineau motor can be used, and can be powered by any well known method, such as the electro-hydraulic power pack shown in FIG. 5, but this particular source of power is not essential to the invention.

Figure 6:
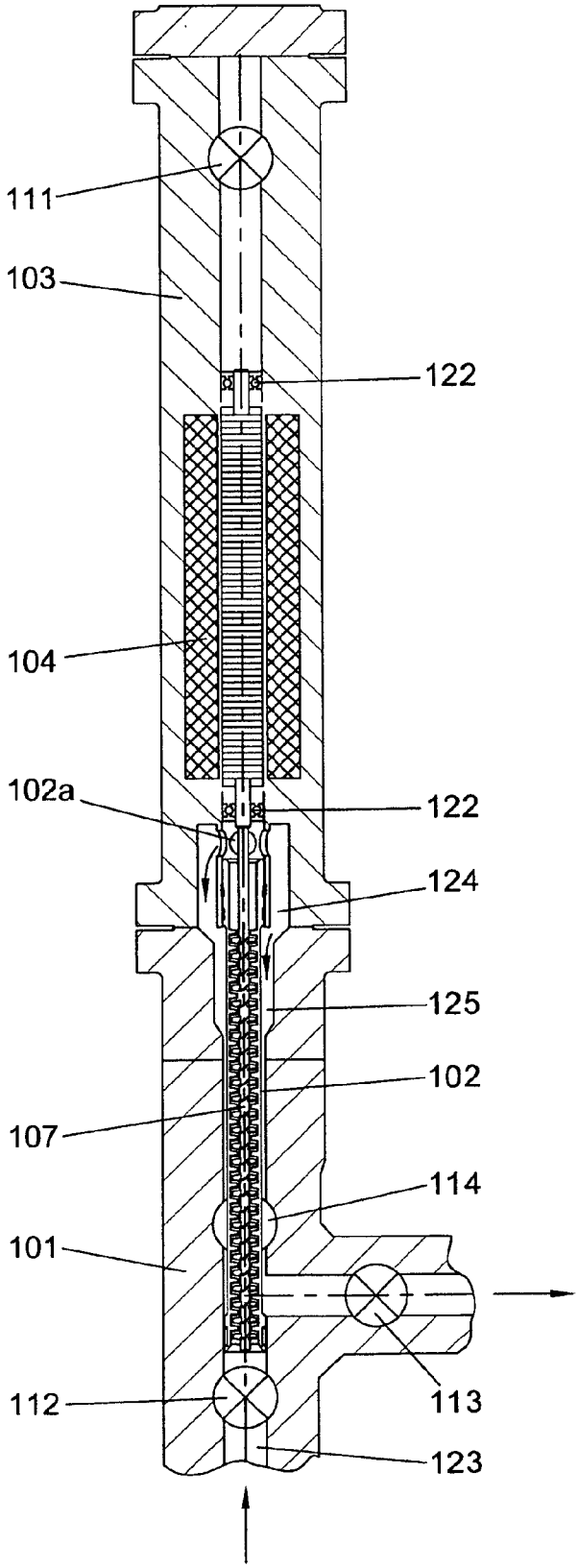
FIG. 6 shows a similar view of a second embodiment.

FIG. 6 shows a different embodiment that uses an electric motor 104 instead of the turbine motor 108 to rotate the shaft and the turbine pump 107. The electric motor 104 can be powered from an external or a local power source, to which it is connected by cables (not shown) in a conventional manner. The electric motor 104 can be substituted for a hydraulic motor or air motor as required.

Like the FIG. 5 embodiment, the direction of rotation of the shaft can be varied by changing the direction of operation of the motor 104, so as to change the direction of flow of the fluid by the arrows in FIG. 6 to the reverse direction.

Like the FIG. 5 embodiment, the FIG. 6 assembly can be retrofitted to existing designs of christmas trees, and can be fitted to many different tree bore diameters. The embodiments described can also be incorporated into new designs of christmas tree as integral features rather than as retrofit assemblies.

Figure 7:
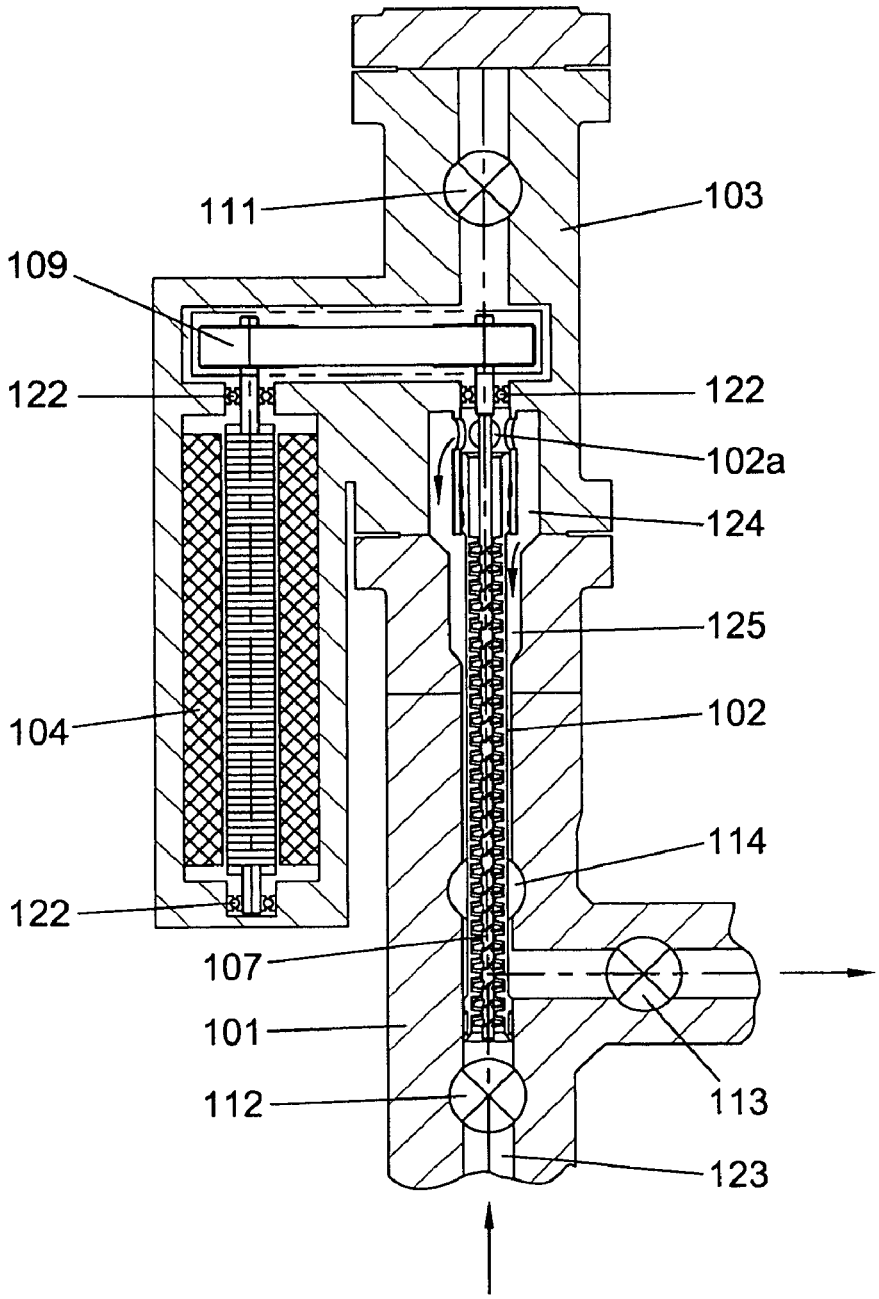
FIG. 7 shows a similar view of a third embodiment.

FIG. 7 shows a further embodiment which illustrates that the connection between the shafts of the motor and the pump can be direct or indirect. In the FIG. 7 embodiment, which is otherwise similar to the previous two embodiments described, the electrical motor 104 powers a drive belt 109, which in turn powers the shaft of the pump 107. This connection between the shafts of the pump and motor permits a more compact design of cap 103. The drive belt 109 illustrates a direct mechanical type of connection, but could be substituted for a chain drive mechanism, or a hydraulic coupling, or any similar indirect connector such as a hydraulic viscous coupling or well known design.

Like the preceding embodiments, the FIG. 7 embodiment can be operated in reverse to draw fluids in the opposite direction of the arrows shown, if required to inject fluids such as water, chemicals for treatment, or drill cuttings for disposal into the well.

Figure 8:
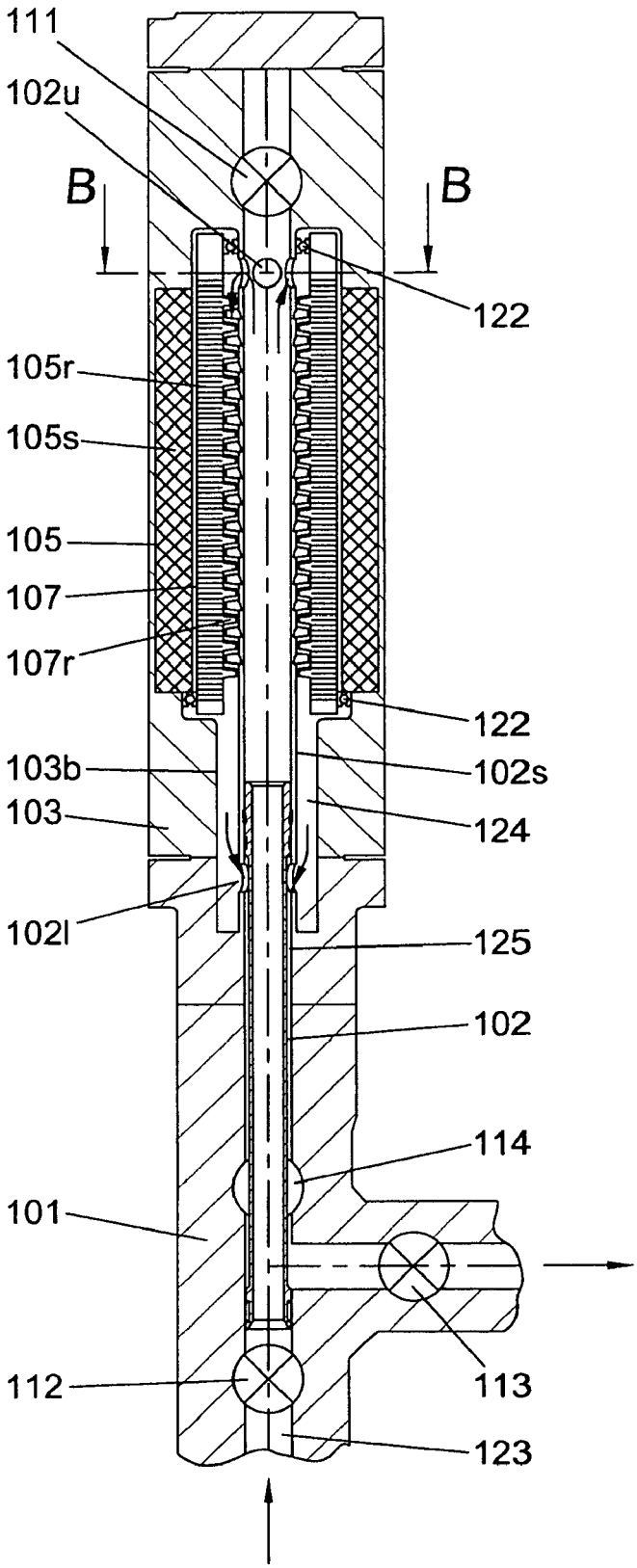
FIG. 8 shows a similar view of a fourth embodiment.
Figure 8:
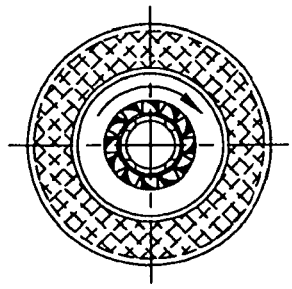

FIG. 8 shows a further modified embodiment using a hollow turbine shaft 102*s* that draws fluid from the production bore 123 through the inside of conduit 102 and into the inlet of a combined motor and pump unit 105, 107. The motor/pump unit has a hollow shaft design, where the pump rotor 107*r* is arranged concentrically inside the motor rotor 105*r*, both of which are arranged inside a motor stator 105*s*. The pump rotor 107*r* and the motor rotor 105*r* rotate as a single piece on bearings 122 around the static hollow shaft 102*s* thereby drawing fluid from the inside of the shaft 102 through the upper apertures 102*u*, and down through the annulus 124 between the shaft 102*s* and the bore 103*b* of the cap 103. The lower portion of the shaft 102*s* is apertured at 102*l*, and the outer surface of the conduit 102 is sealed within the bore of the shaft 102*s* above the lower aperture 102*l*, so that fluid pumped from the annulus 124 and entering the apertures 102*l*, continues flowing through the annulus 125 between the conduit 102 and the shaft 102*s* into the production bore 123, and finally through the production wing valve 113 for export as normal.

The motor can be any prime mover of hollow shaft construction, but electric or hydraulic motors can function adequately in this embodiment. The pump design can be of any suitable type, but a moineau motor, or a turbine as shown here, are both suitable.

Like previous embodiments, the direction of flow of fluid through the pump shown in FIG. 8 can be reversed simply by reversing the direction of the motor, so as to drive the fluid in the opposite direction of the arrows shown in FIG. 8.

Figure 9A:
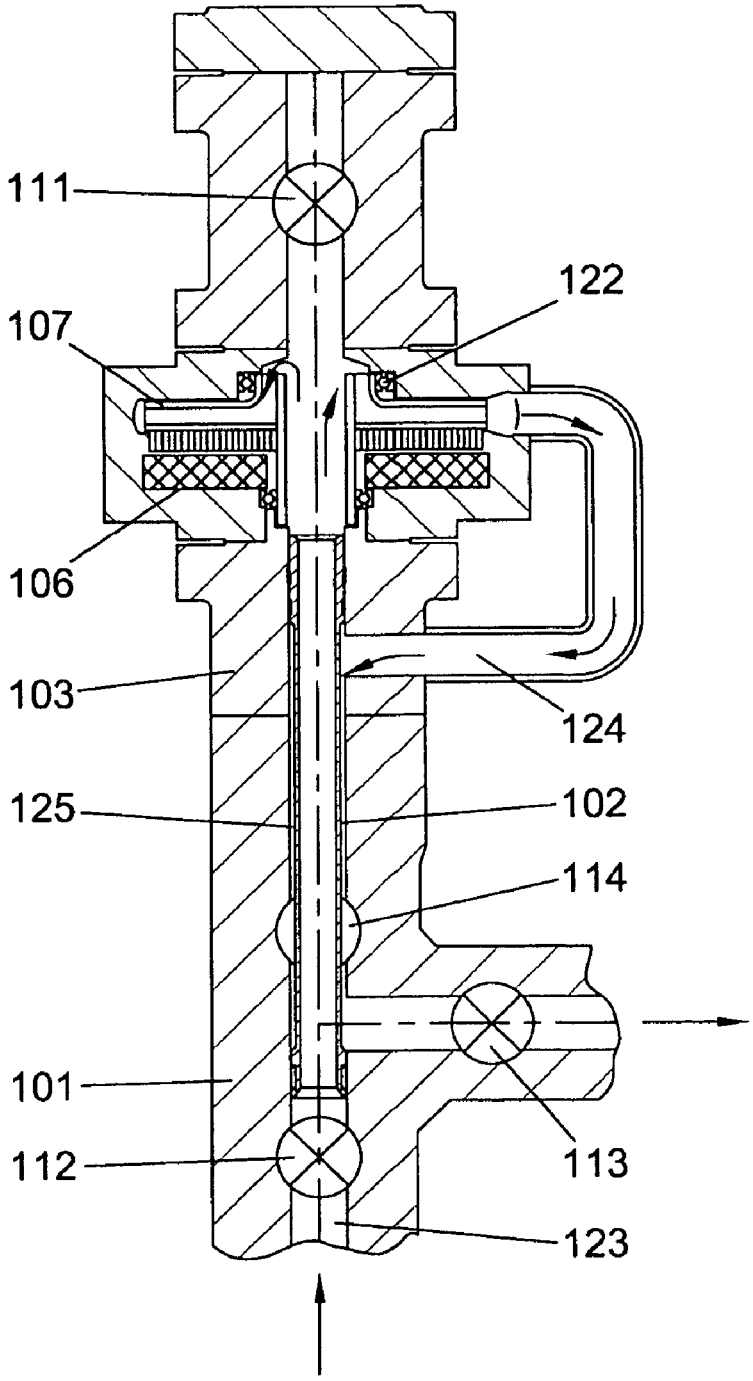
FIG. 9 shows a similar view of a fifth embodiment.

Referring now to FIG. 9*a*, this embodiment employs a motor 106 in the form of a disc rotor that is preferably electrically powered, but could be hydraulic or could derive power from any other suitable source, connected to a centrifugal disc-shaped pump 107 that draws fluid from the production bore 123 through the inner bore of the conduit 102 and uses centrifugal impellers to expel the fluid radially outwards into collecting conduits 124, and thence into an annulus 125 formed between the conduit 102 and the production bore 123 in which it is sealed. As previously described in earlier embodiments, the fluid propelled down the annulus 125 cannot pass the seal at the lower end of the conduit 102 below the production wing branch, and exits through the production wing valve 113.

Figure 9B:
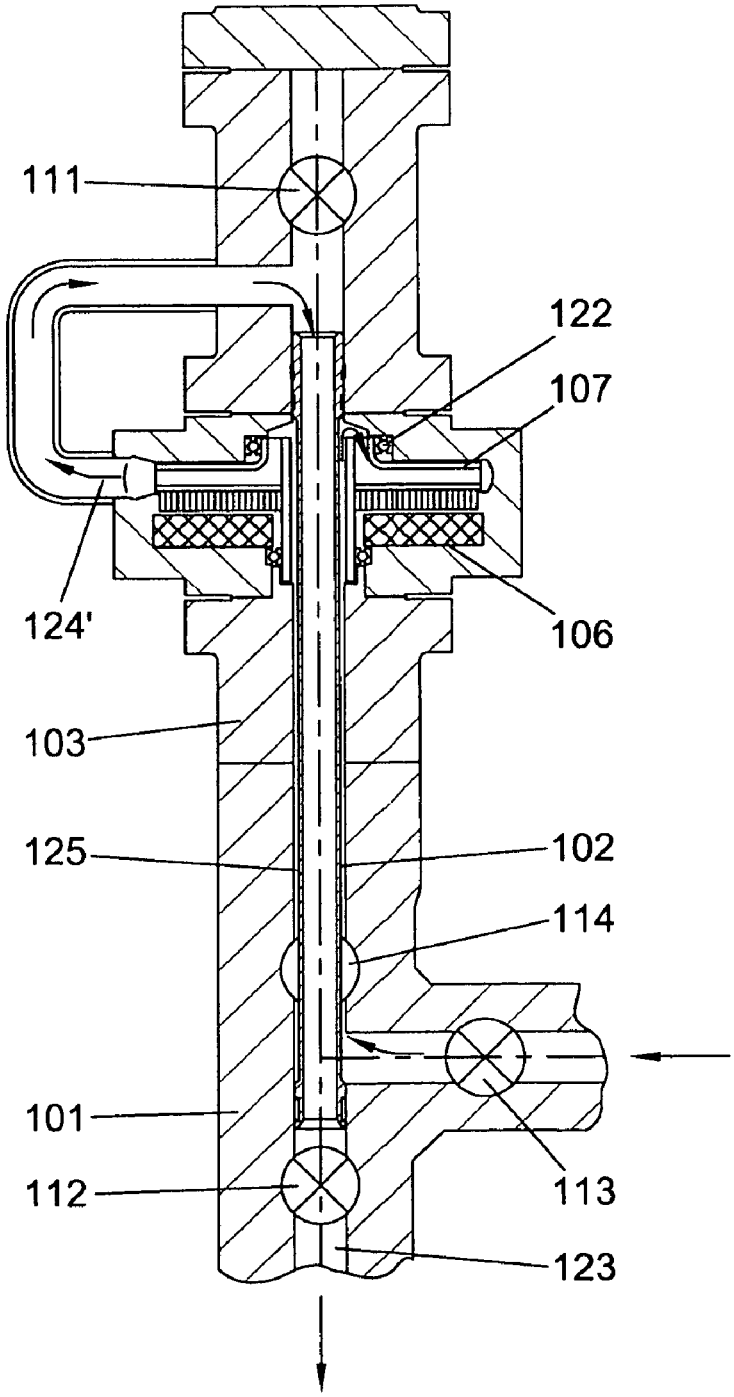

FIG. 9*b* shows the same pump configured to operate in reverse, to draw fluids through the production wing valve 113, into the conduit 125, across the pump 107, through the re-routed conduit 124' and conduit 102, and into the production bore 123.

One advantage of the FIG. 9 design is that the disc shaped motor and pump illustrated therein can be duplicated to provide a multi-stage pump with several pump units connected in series and/or in parallel in order to increase the pressure at which the fluid is pumped through the production wing valve 113.

Figure 10A:
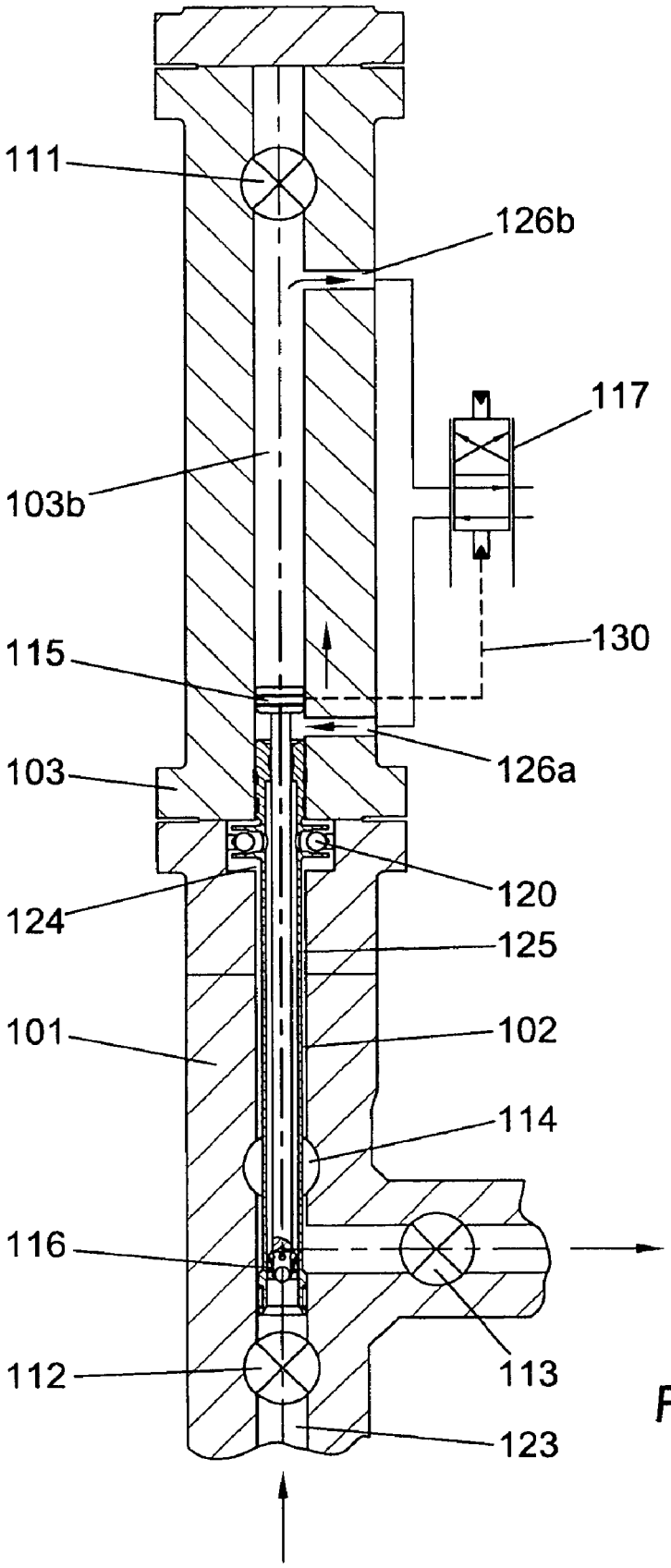
FIGS. 10 and 11 show a sixth embodiment.
Figure 10B:
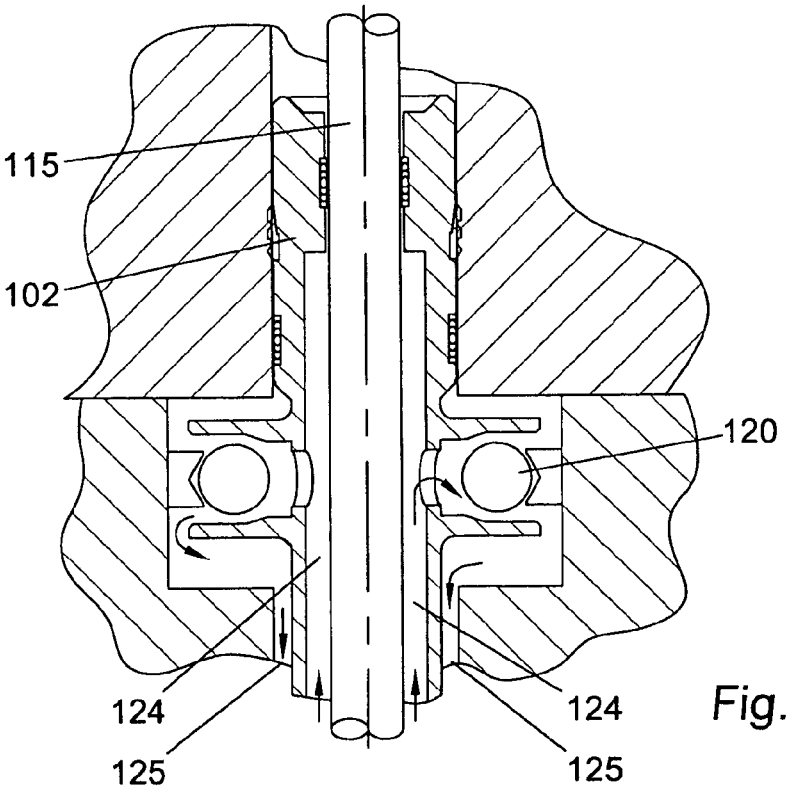
Figure 10C:
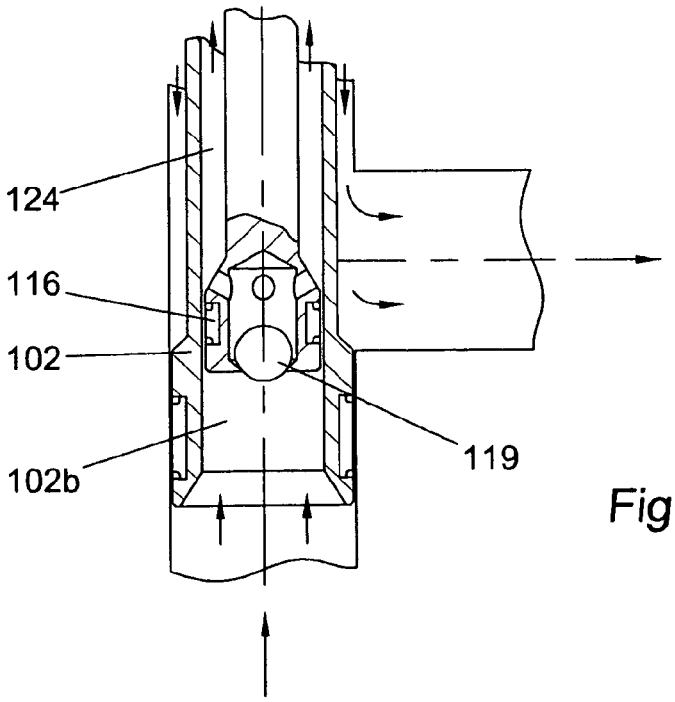
Figure 10D:
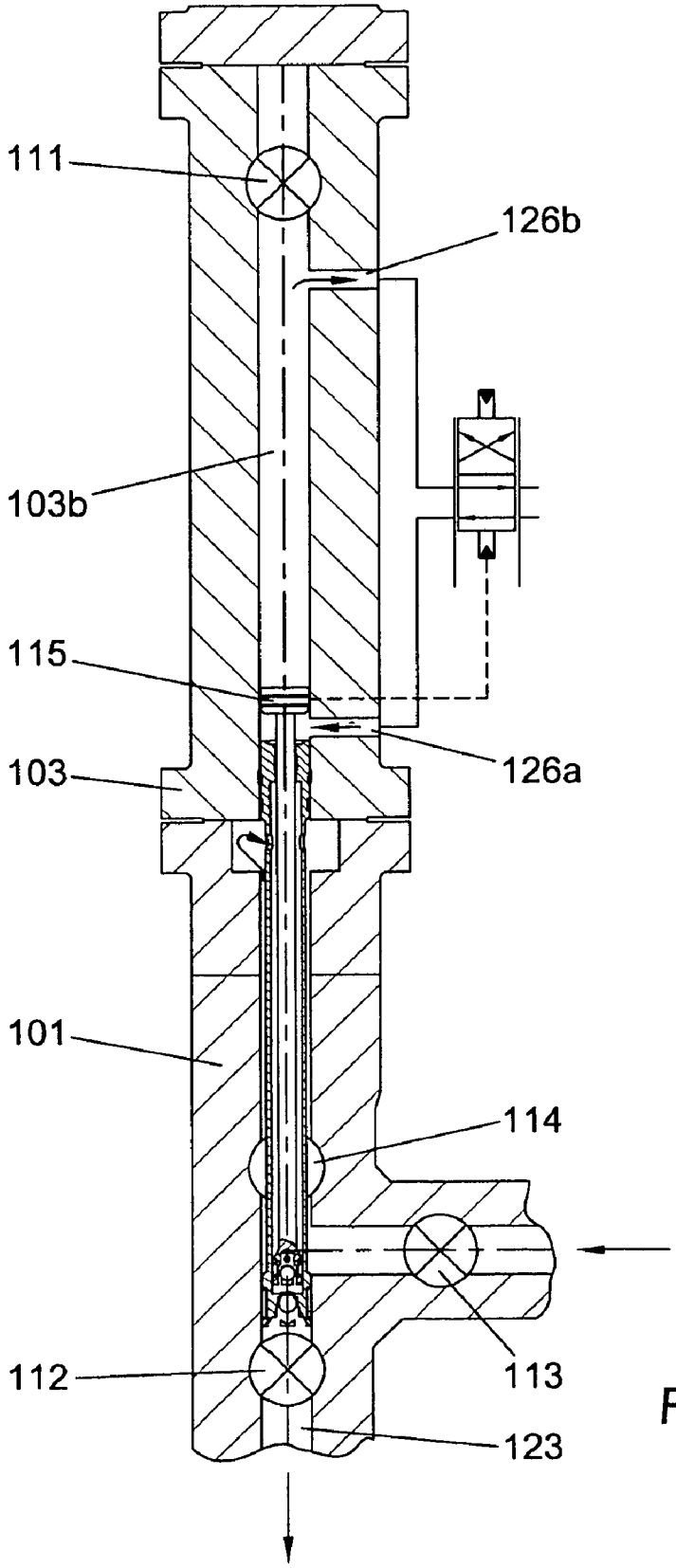
Figure 11A:
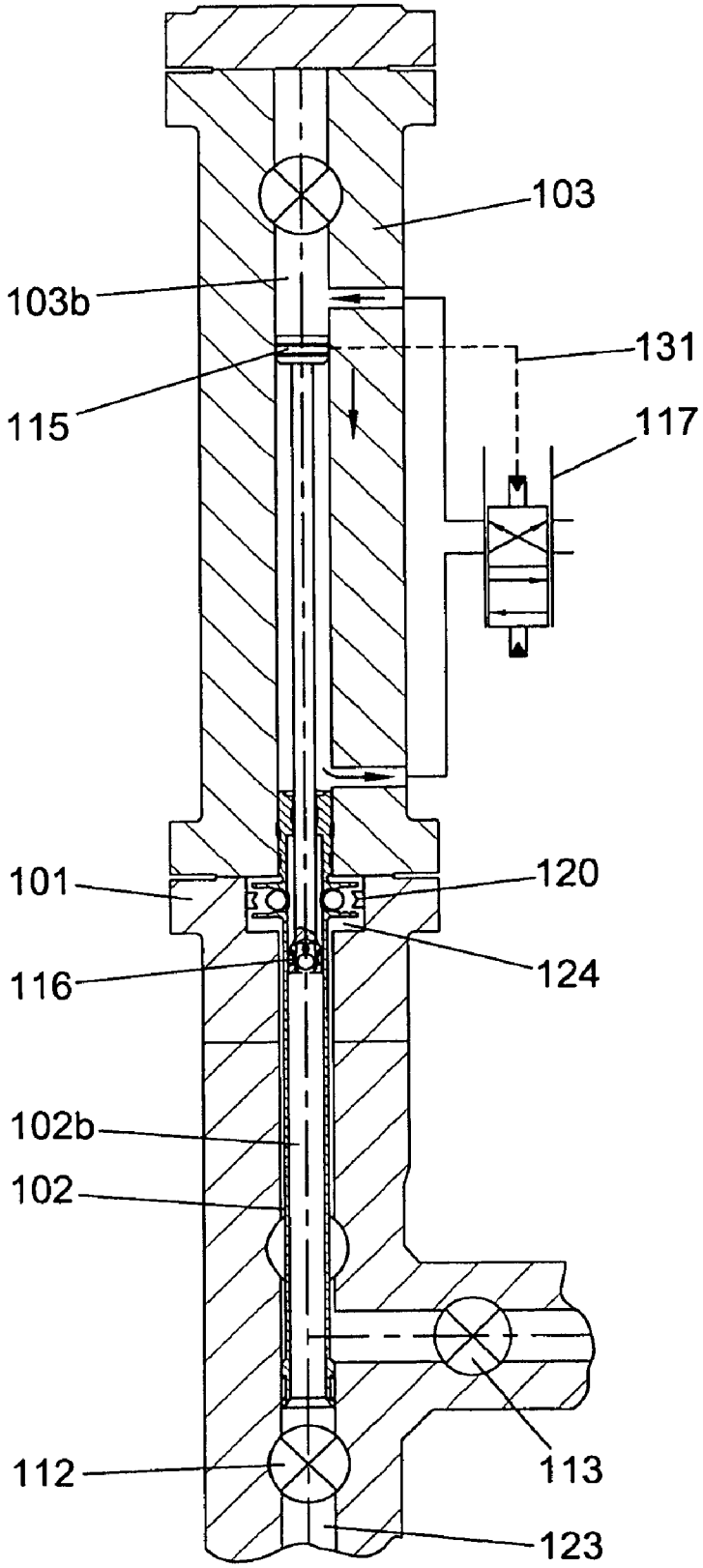
Figure 11B:
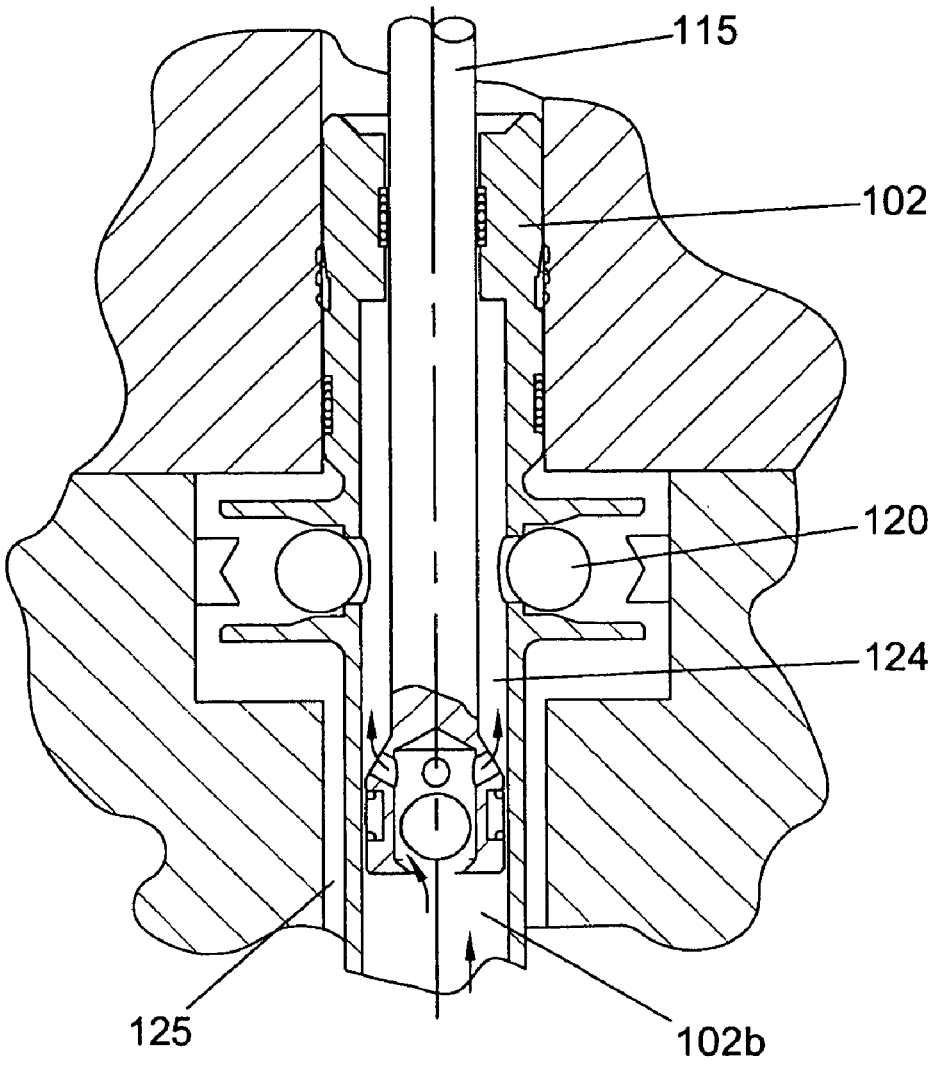

Referring now to FIGS. 10 and 11, this embodiment illustrates a piston 115 that is sealed within the bore 103*b* of the cap 103, and connected via a rod to a further lower piston assembly 116 within the bore of the conduit 102. The conduit 102 is again sealed within the bore 103*b* and the production bore 123. The lower end of the piston assembly 116 has a check valve 119.

The piston 115 is moved up from the lower position shown in FIG. 10*a* by pumping fluid into the aperture 126*a* through the wall of the bore 103*b* by means of a hydraulic power pack in the direction shown by the arrows in FIG. 10*a*. The piston annulus is sealed below the aperture 126*a*, and so a build-up of pressure below the piston pushes it upward towards the aperture 126*b*, from which fluid is drawn by the hydraulic power pack. As the piston 115 travels upward, a hydraulic signal 130 is generated that controls the valve 117, to maintain the direction of the fluid flow shown in FIG. 10*a*. When the piston 115 reaches its uppermost stroke, another signal 131 is generated that switches the valve 117 and reverses direction of fluid from the hydraulic power pack, so that it enters through upper aperture 126*b*, and is exhausted through lower aperture 126*a*, as shown in FIG. 11*a*. Any other similar switching system could be used, and fluid lines are not essential to the invention.

As the piston is moving up as shown in FIG. 10*a*, production fluids in the production bore 123 are drawn into the bore 102*b* of the conduit 102, thereby filling the bore 102*b* of the conduit underneath the piston. When the piston reaches the upper extent of its travel, and begins to move downwards, the check valve 119 opens when the pressure moving the piston downwards exceeds the reservoir pressure in the production bore 123, so that the production fluids 123 in the bore 102*b* of the conduit 102 flow through the check valve 119, and into the annulus 124 between the conduit 102 and the piston shaft. Once the piston reaches the lower extent of its stroke, and the pressure between the annulus 124 and the production bore 123 equalises, the check valve 119 in the lower piston assembly 116 closes, trapping the fluid in the annulus 124 above the lower piston assembly 116. At that point, the valve 117 switches, causing the piston 115 to rise again and pull the lower piston assembly 116 with it. This lifts the column of fluid in the annulus 124 above the lower piston assembly 116, and once sufficient pressure is generated in the fluid in the annulus 124 above lower piston assembly 116, the check valves 120 at the upper end of the annulus open, thereby allowing the well fluid in the annulus to flow through the check valves 120 into the annulus 125, and thereby exhausting through wing valve 113 branch conduit. When the piston reaches its highest point, the upper hydraulic signal 131 is triggered, changing the direction of valve 117, and causing the pistons 115 and 116 to move down their respective cylinders. As the piston 116 moves down once more, the check valve 119 opens to allow well fluid to fill the displaced volume above the moving lower piston assembly 116, and the cycle repeats.

The fluid driven by the hydraulic power pack can be driven by other means. Alternatively, linear oscillating motion can be imparted to the lower piston assembly 116 by other well-known methods i.e. rotating crank and connecting rod, scotch yolk mechanisms etc.

By reversing and/or re-arranging the orientations of the check valves 119 and 120, the direction of flow in this embodiment can also be reversed, as shown in FIG. 10*d*.

The check valves shown are ball valves, but can be substituted for any other known fluid valve. The FIGS. 10 and 11 embodiment can be retrofitted to existing trees of varying diameters or incorporated into the design of new trees.

Figure 12A:
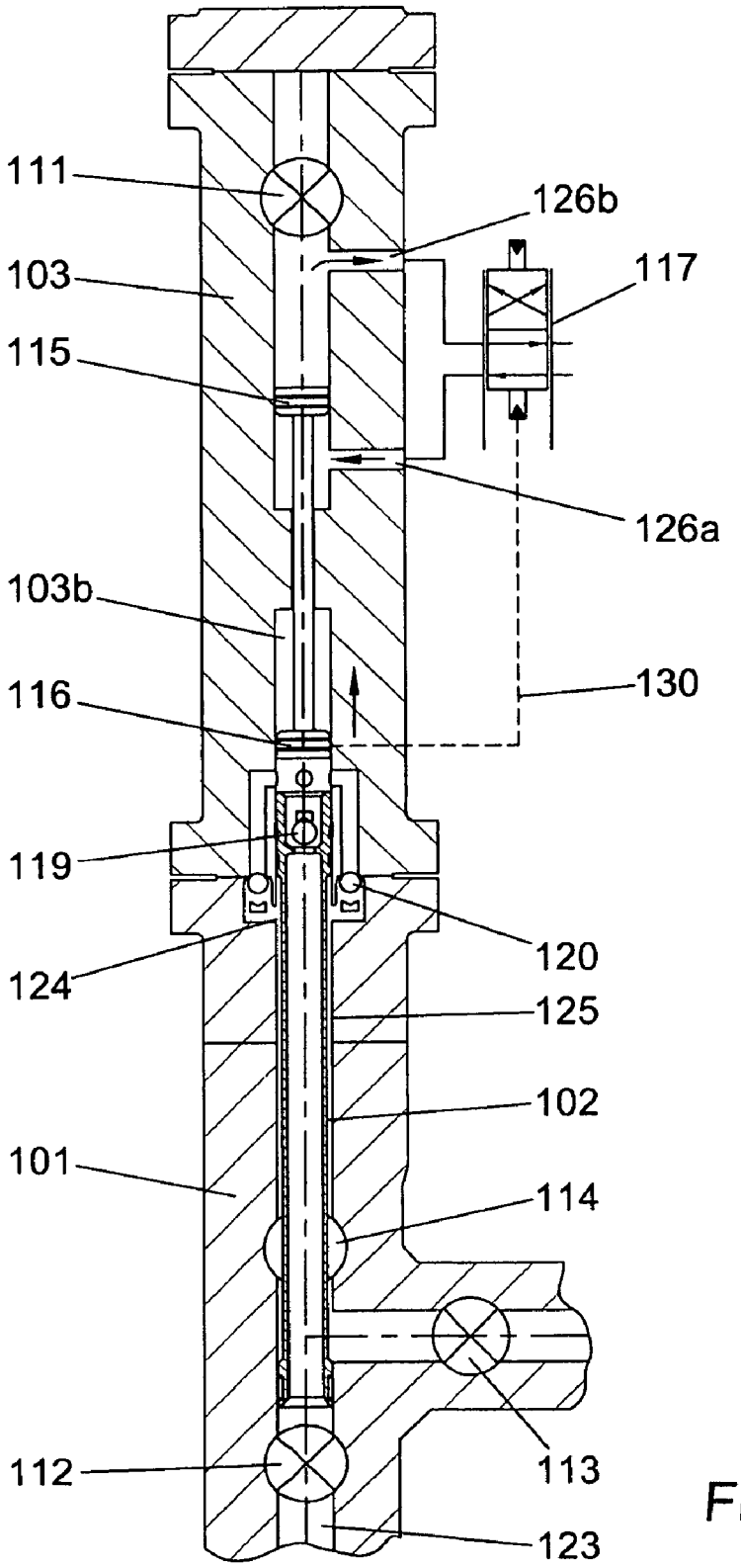
FIGS. 12 and 13 show a seventh embodiment.
Figure 12B:
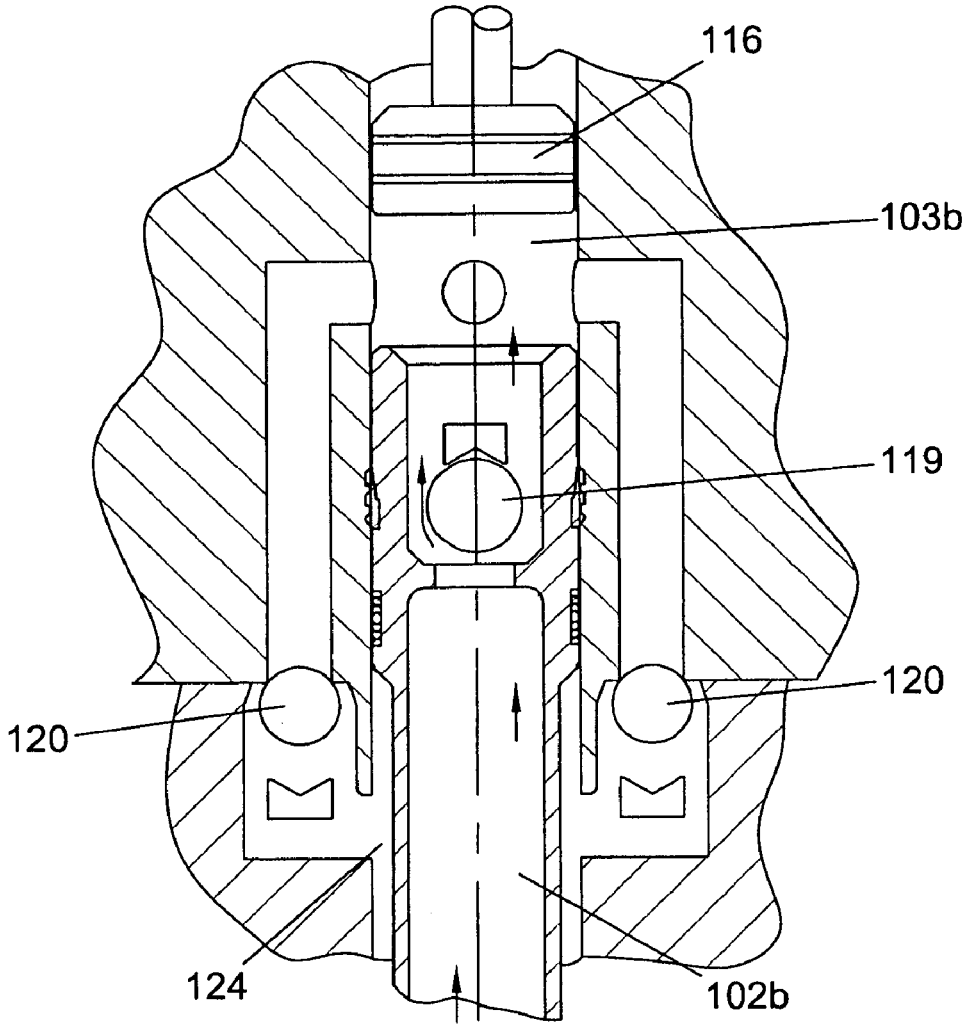
Figure 13A:
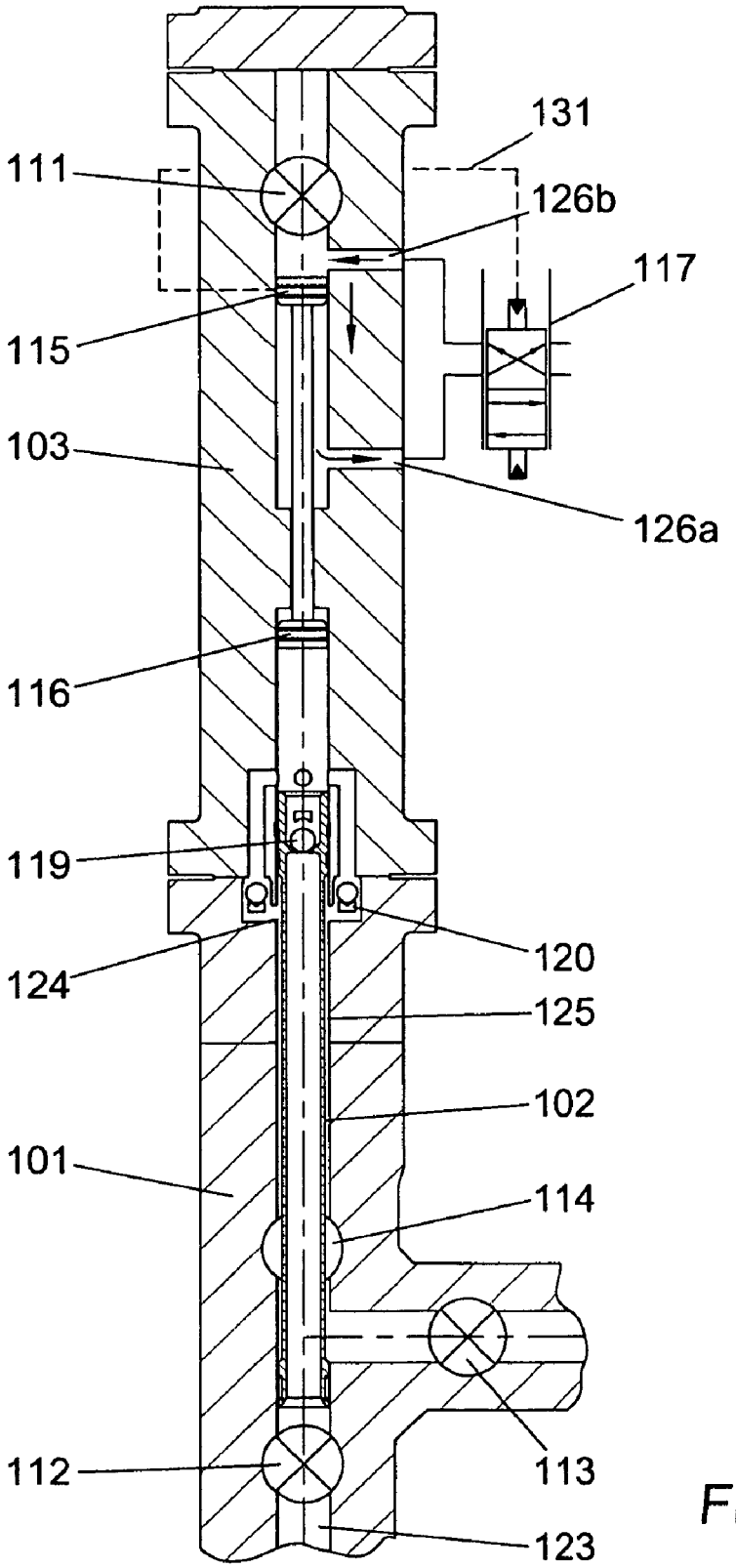
Figure 13B:
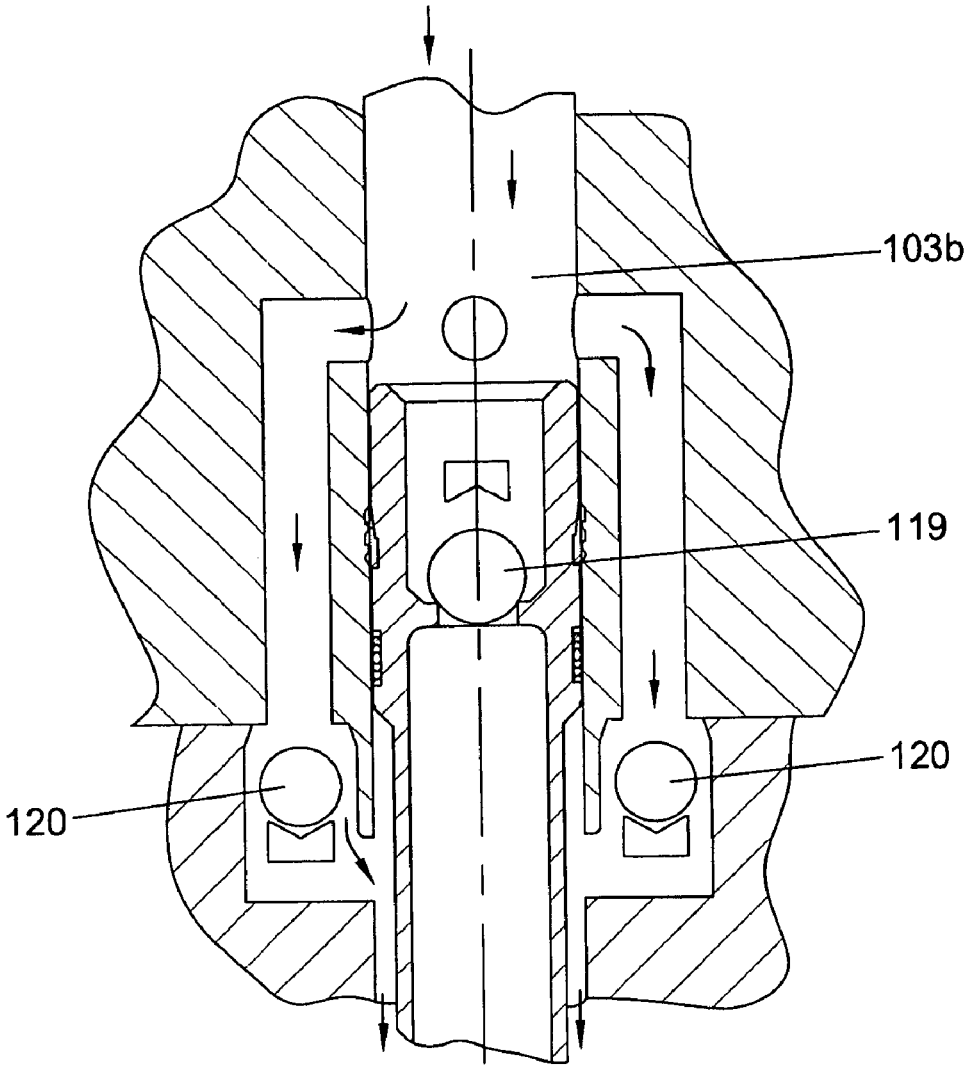

Referring now to FIGS. 12 and 13, a further embodiment has a similar piston arrangement as the embodiment shown in FIGS. 10 and 11, but the piston assembly 115, 116 is housed within a cylinder formed entirely by the bore 103*b* of the cap 103. As before, drive fluid is pumped by the hydraulic power pack into the chamber below the upper piston 115, causing it to rise as shown in FIG. 12*a*, and the signal line 130 keeps the valve 117 in the correct position as the piston 115 is rising. This draws well fluid through the conduit 102 and check valve 119 into the chamber formed in the cap bore 103*b*. When the piston has reached its full stroke, the signal line 131 is triggered to switch the valve 117 to the position shown in FIG. 13*a*, so that drive fluid is pumped in the other direction and the piston 115 is pushed down. This drives piston 116 down the bore 103*b* expelling well fluid through the check valves 120 (valve 119 is closed), into annulus 124, 125 and through the production wing valve 113. In this embodiment the check valve 119 is located in the conduit 102, but could be immediately above it. By reversing the orientation of the check valves as in previous embodiments the flow of the fluid can be reversed.

Figure 14A:
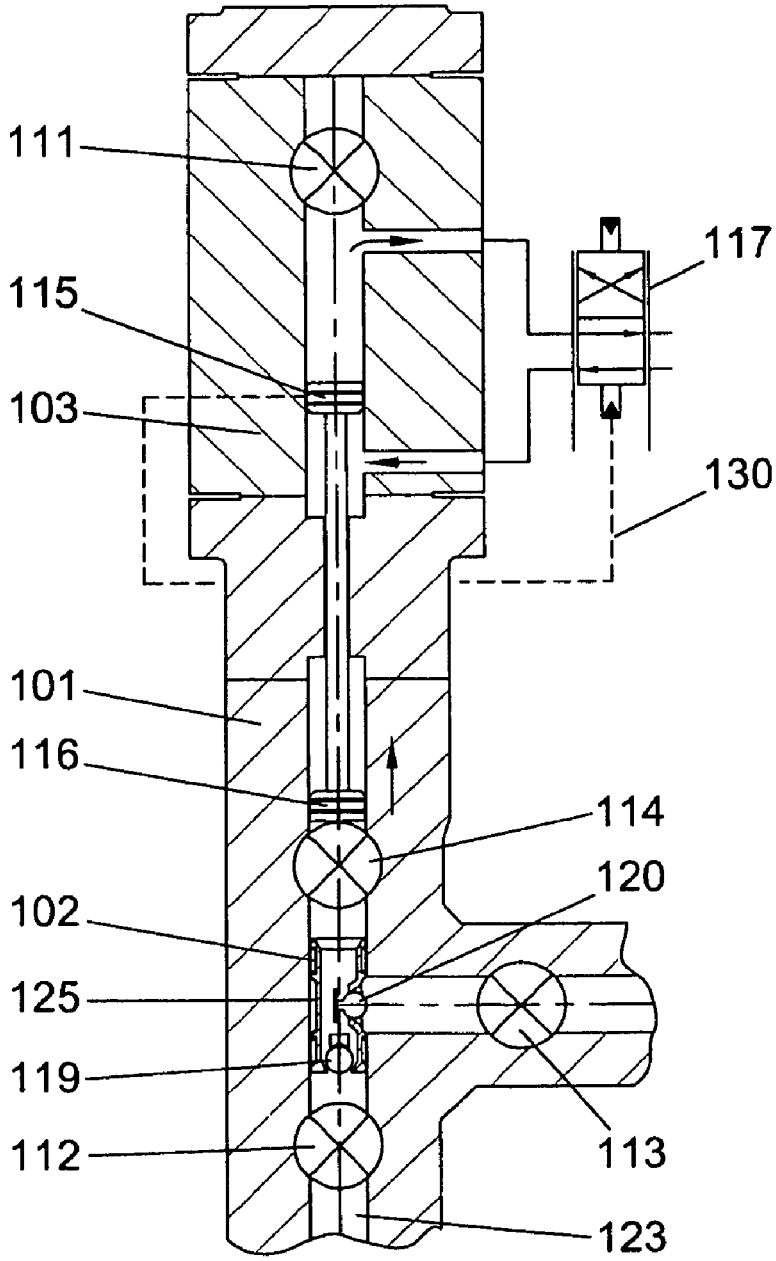
FIGS. 14 and 15 show an eighth embodiment.
Figure 14B:
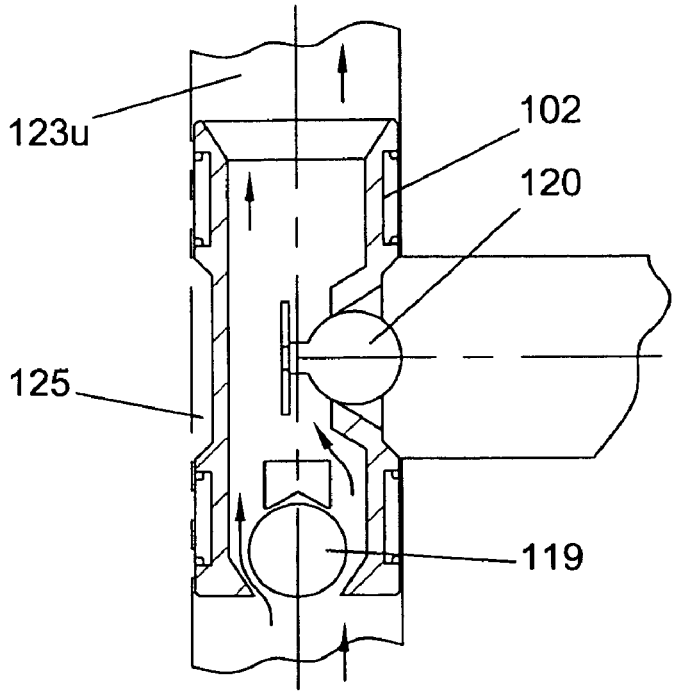
Figure 15B:
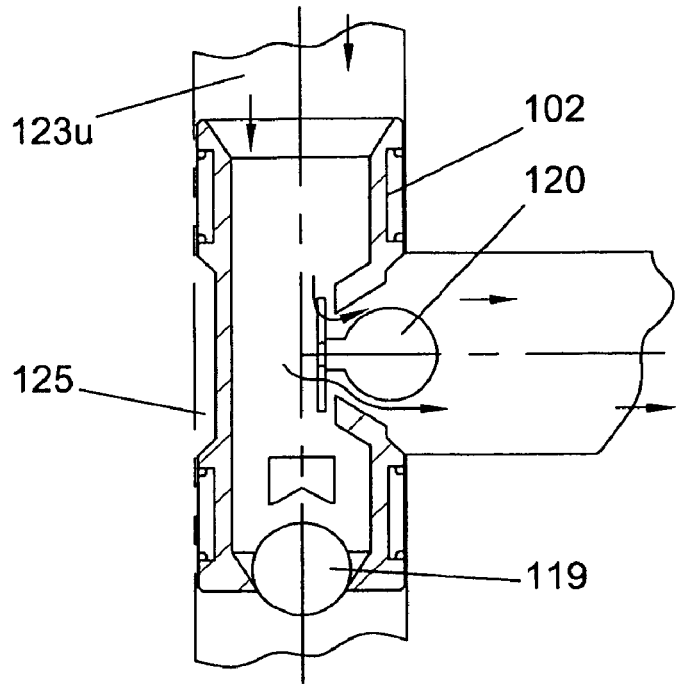
Figure 15A:
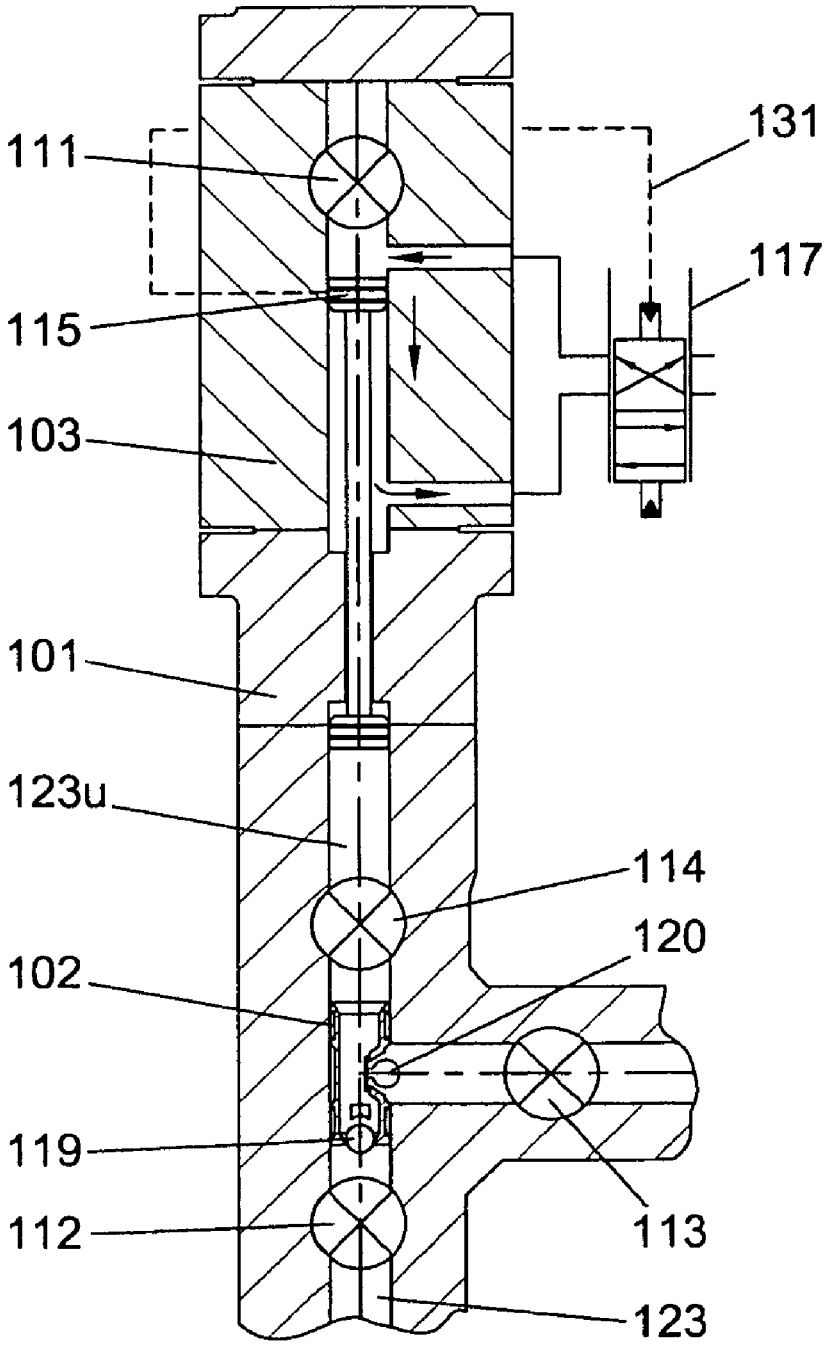

A further embodiment is shown in FIGS. 14 and 15, which works in a similar fashion but has a short diverter assembly 102 sealed to the production bore and straddling the production wing branch. The lower piston 116 strokes in the production bore 123 above the diverter assembly 102. As before, the drive fluid raises the piston 115 in a first phase shown in FIG. 14, drawing well fluid through the check valve 119, through the diverter assembly 102 and into the upper portion of the production bore 123. When the valve 117 switches to the configuration shown in FIG. 15, the pistons 115, 116 are driven down, thereby expelling the well fluids trapped in the bore 123*u*, through the check valve 120 (valve 119 is closed) and the production wing valve 113.

Figure 16A:
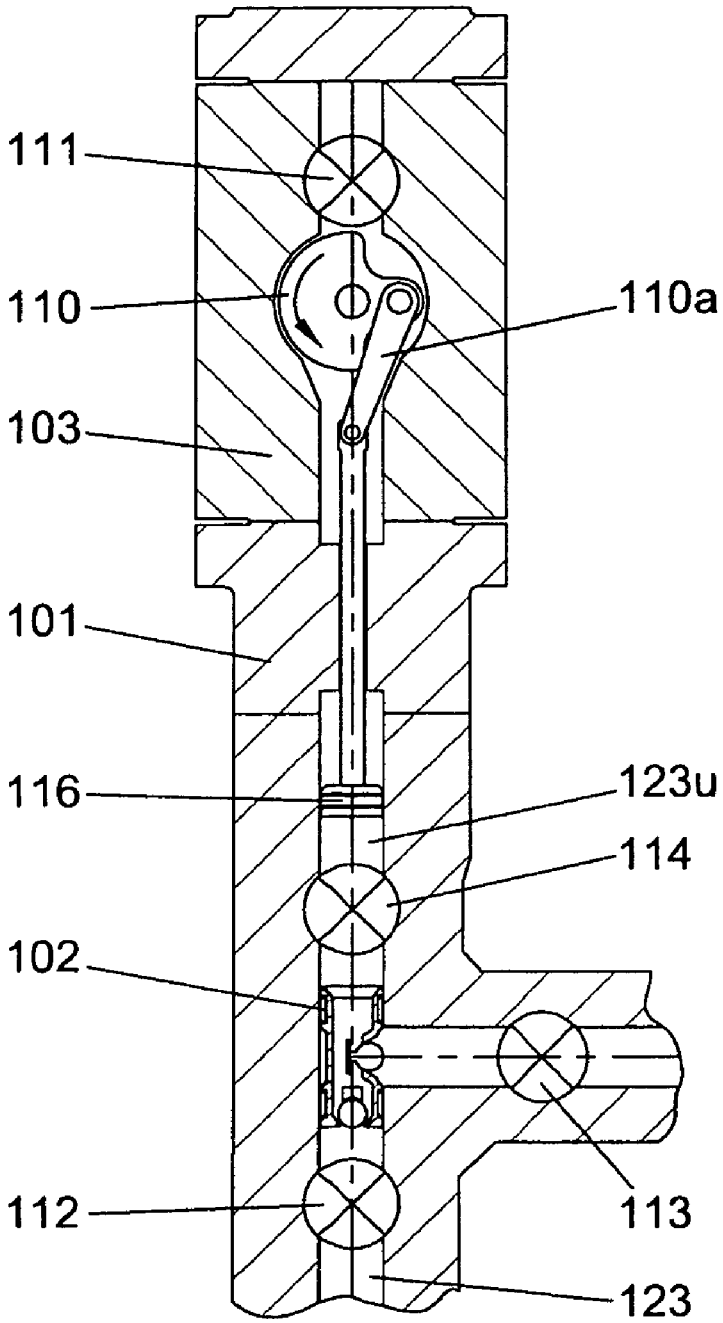
FIG. 16 shows ninth embodiment.
Figure 16B:
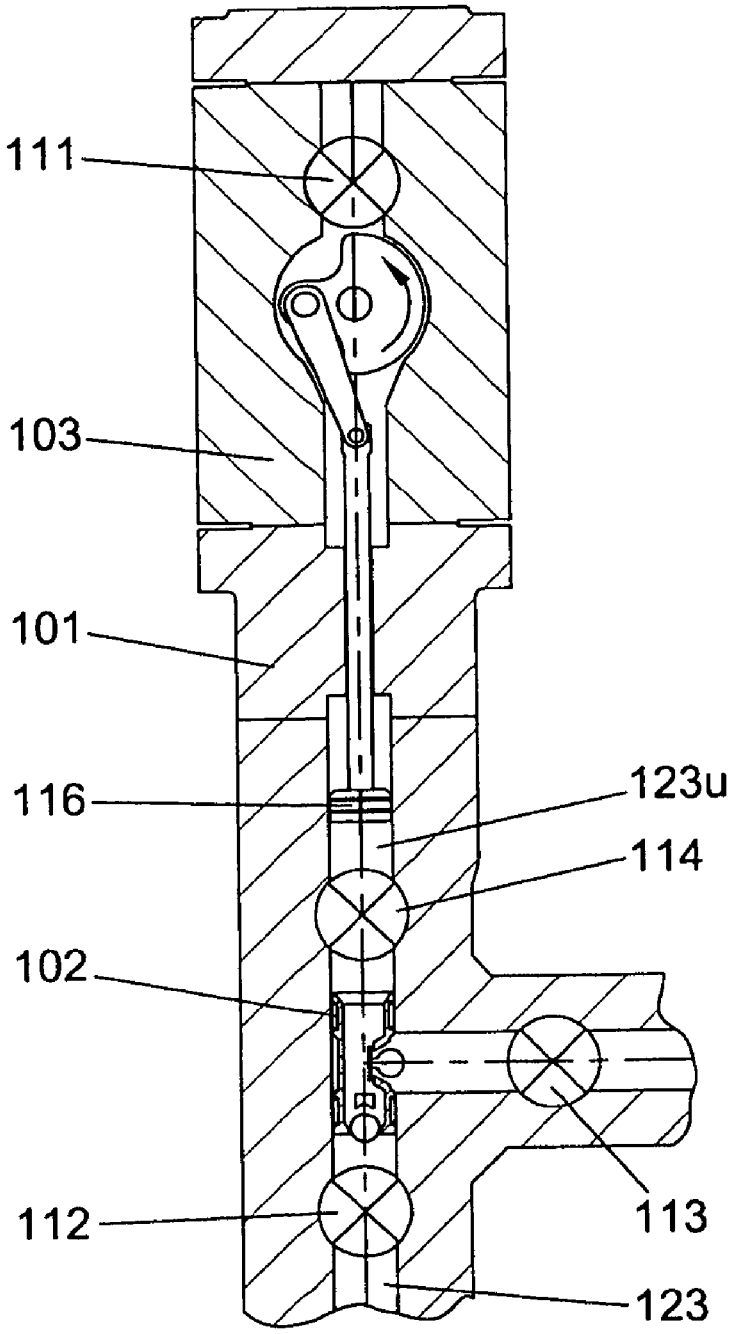

FIG. 16 shows a further embodiment, which employs a rotating crank 110 with an eccentrically attached arm 110*a* instead of a fluid drive mechanism to move the piston 116. The crank 110 is pulling the piston upward when in the position shown in FIG. 16*a*, and pushing it downward when in the position shown in 112*b*. This draws fluid into the upper part of the production bore 123*u* as previously described. The straddle 102 and check valve arrangements as described in the previous embodiment.

Figure 18:
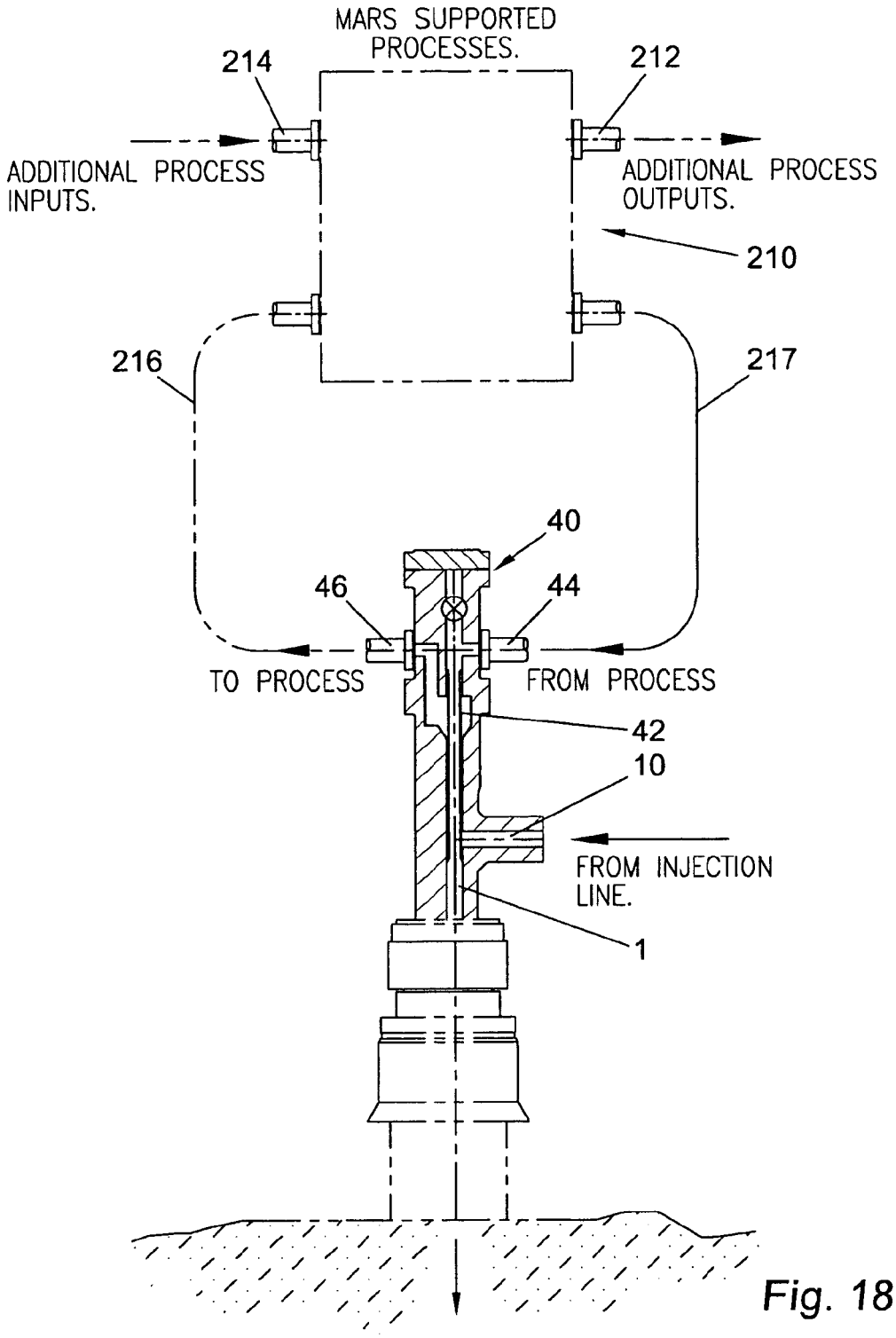
FIG. 18 shows a schematic diagram of the FIG. 2 embodiment engaged with an injection well.

The apparatus of the present invention can also be used to inject fluids into a well, simply by operating the apparatus in reverse, as shown schematically in FIG. 18. FIG. 18 shows a christmas tree connected to, e.g. the FIG. 2 embodiment (although it could also be connected to any of the other embodiments described above). The line 10, which previously served as an export line, now serves as an injection line. The fluids pass into the annulus between the conduit 42 and what was the production bore, and out through outlet 46 (which formerly served as an inlet) through tubing 216 and into processing apparatus 210.

Processing apparatus 210 may comprise or include pressure boosting apparatus (e.g. a pump or process fluid turbine). Processing apparatus 210 may also enable chemical injection (e.g. viscosity moderators, surfactants, pipe skin moderators, refrigerants, well fracturing chemicals) and injection of gas/steam/sea water/drill cuttings/waste material. The added material above typically enters processing apparatus 210 via one or more inlets 214. One or more outlets 212 may also be provided.

Injecting sea water into a well could be useful to boost the formation pressure for recovery of hydrocarbons from the well, and to maintain the pressure in the underground formation against collapse. Also, injecting waste gases or drill cuttings etc into a well obviates the need to dispose of these at the surface, which can prove expensive and environmentally damaging.

Figure 17:
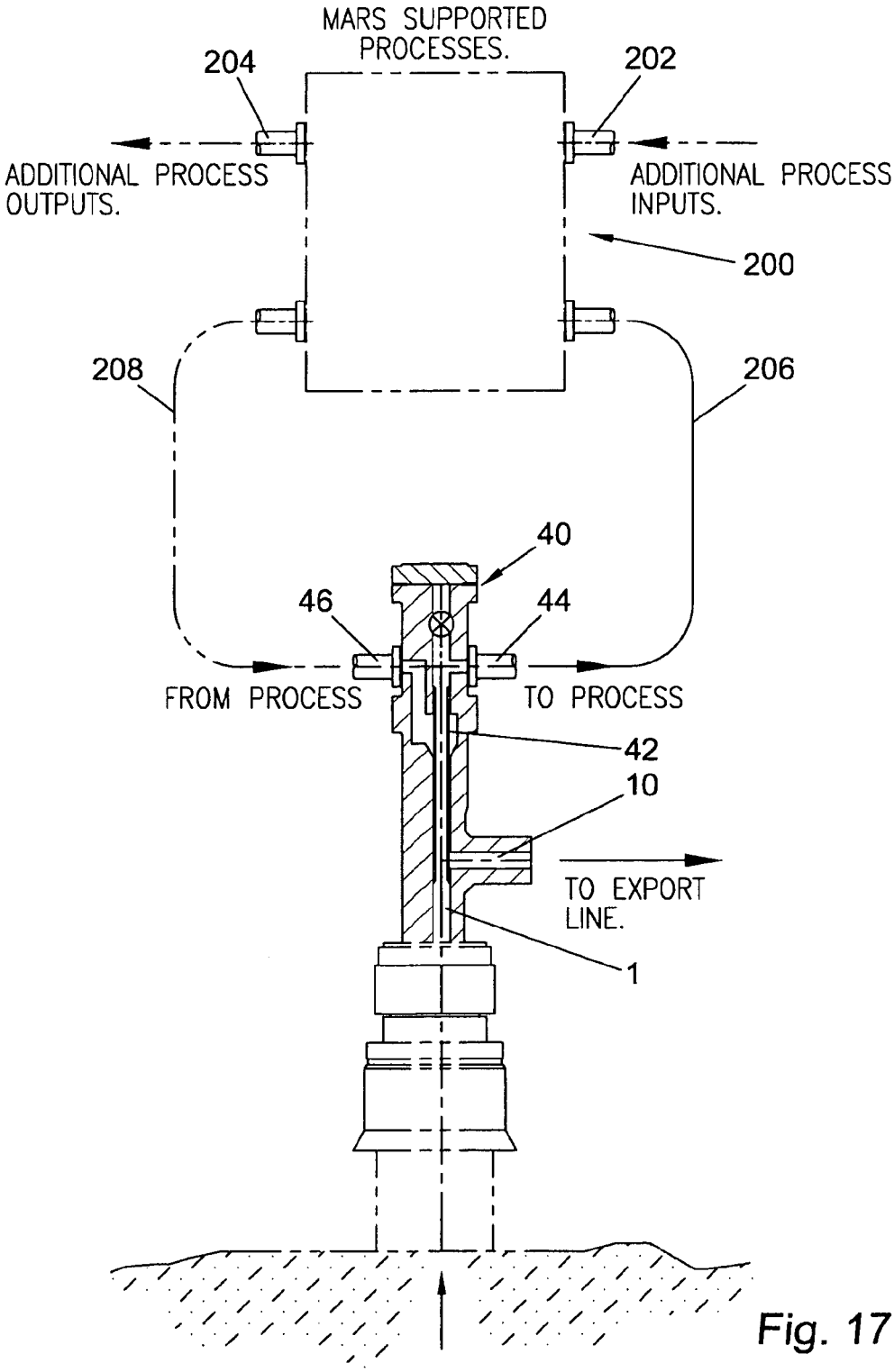
FIG. 17 shows a schematic diagram of the FIG. 2 embodiment coupled to processing apparatus.

As in the FIG. 17 embodiment, processing apparatus 210 could also include fluid measurement apparatus (e.g. temperature). Furthermore, processing apparatus 210 could include injection water electrolysis equipment.

After processing, the fluids are returned via tubing 217 to inlet 44 of the christmas tree. From here, the fluids pass through the inside of conduit 42 directly into the production bore and down into the depths of the well.

Figure 19:
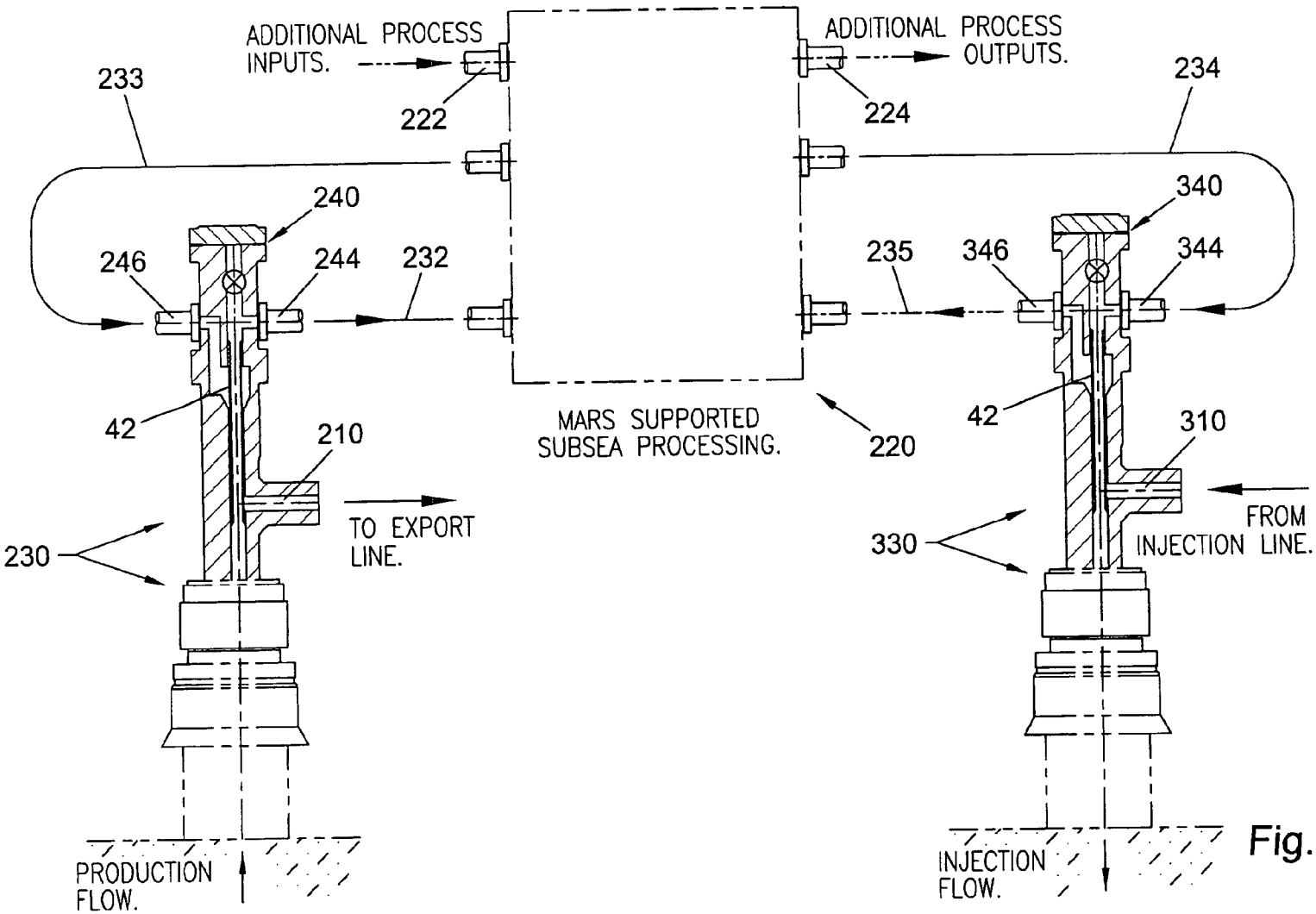
FIG. 19 shows a schematic diagram of two embodiments of the invention engaged with a production well and an injection well respectively, the two wells being connected via a processing apparatus.
Figure 20:
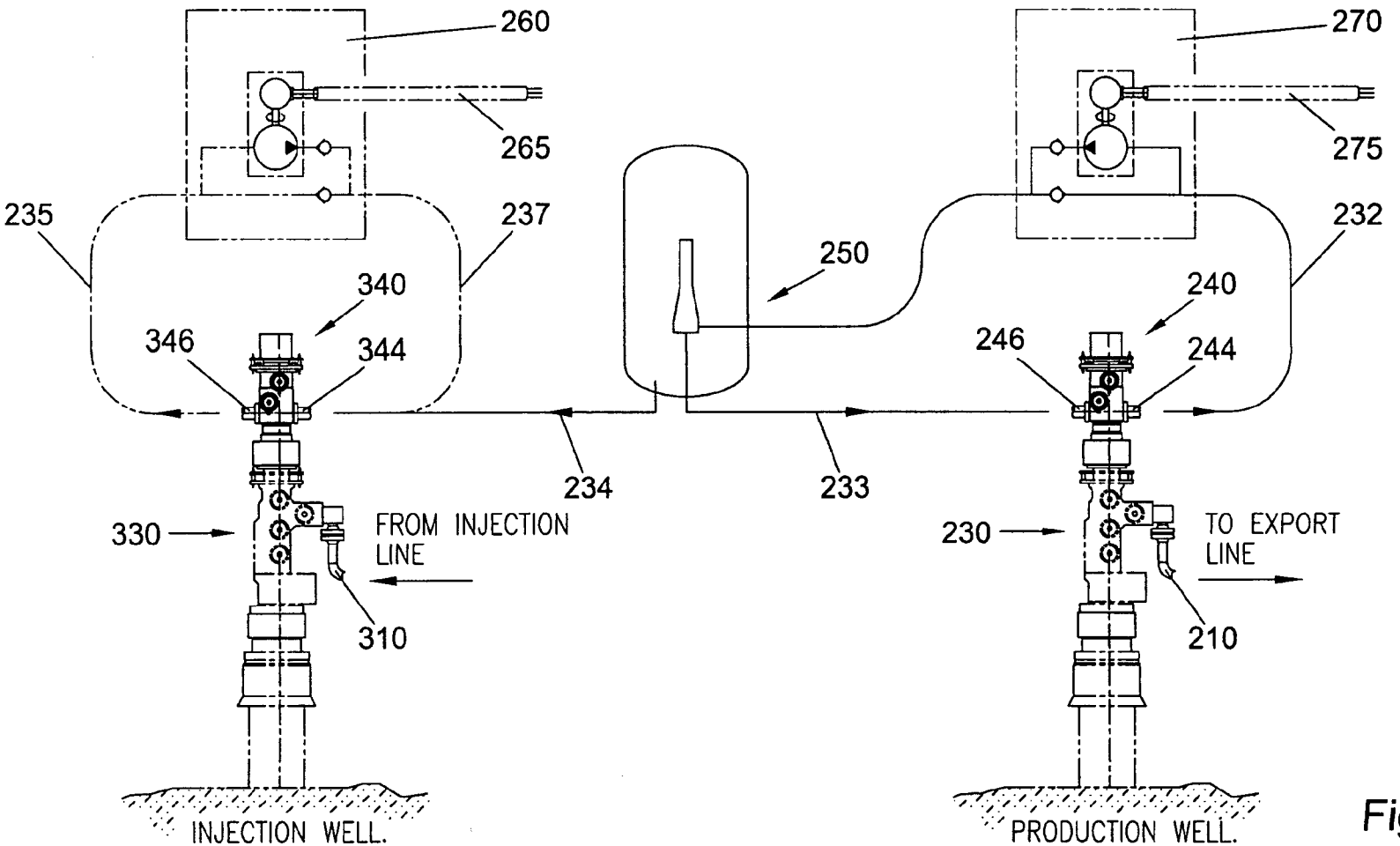
FIG. 20 shows a specific example of the FIG. 19 embodiment.

The present invention can also usefully be used in multiple well combinations, as shown in FIGS. 19 and 20. FIG. 19 shows a general arrangement, whereby a production well 230 and an injection well 330 are connected together via processing apparatus 220.

Production well 230 can be any of the capped production well embodiments described above. Injection well 330 can also be any of the abovedescribed production well embodiments, with outlets and inlets reversed.

Produced fluids from production well 230 flow up through the bore of conduit 42, exit via outlet 244, and pass through tubing 232 to processing apparatus 220, which may also have one or more further input lines 222 and one or more further outlet lines 224.

Processing apparatus 220 can be selected to perform any of the functions described above with reference to processing apparatus 200 and 210 in the FIGS. 17 and 18 embodiments. Additionally, processing apparatus 220 can also separate water/gas/oil/sand/debris from the fluids produced from production well 230 and then inject one or more of these into injection well 330. Separating fluids from one well and re-injecting into another well via subsea processing apparatus 220 reduces the quantity of tubing, time and energy necessary compared to performing each function individually as described with respect to the FIG. 17 and FIG. 18 embodiments. Processing apparatus 220 may also include a riser to the surface, for carrying the produced fluids or a separated component of these to the surface.

Tubing 233 connects processing apparatus 220 back to an inlet 246 of a wellhead cap 240 of production well 230. The processing apparatus 220 could also be used to inject gas into the separated hydrocarbons for lift and also for the injection of any desired chemicals such as scale or wax inhibitors. The hydrocarbons are then returned via tubing 233 to inlet 246 and flow from there into the annulus between the conduit 42 and the bore in which it is disposed. As the annulus is sealed at the upper and lower ends, the fluids flow through the export line 210 for recovery.

The horizontal line 310 of injection well 330 serves as an injection line (instead of an export line). Fluids to be injected can enter injection line 310, from where they pass via the annulus between the conduit 42 and the bore to the tree cap outlet 346 and tubing 235 into processing apparatus 220. The processing apparatus may include a pump, chemical injection device, and/or separating devices, etc. Once the injection fluids have been thus processed as required, they can now be combined with any separated water/sand/debris/other waste material from production well 230. The injection fluids are then transported via tubing 234 to an inlet 344 of the cap 340 of injection well 330, from where they pass through the conduit 42 and into the wellbore.

It should be noted that it is not necessary to have any extra injection fluids entering via injection line 310; all of the injection fluids could originate from production well 230 instead. Furthermore, as in the previous embodiments, if processing apparatus 220 includes a riser, this riser could be used to transport the processed produced fluids to the surface, instead of passing them back down into the christmas tree of the production bore again for recovery via export line 210.

FIG. 20 shows a specific example of the more general embodiment of FIG. 19 and like numbers are used to designate like parts. The processing apparatus in this embodiment includes a water injection booster pump 260 connected via tubing 235 to an injection well, a production booster pump 270 connected via tubing 232 to a production well, and a water separator vessel 250, connected between the two wells via tubing 232, 233 and 234. Pumps 260, 270 are powered by respective high voltage electricity power umbilicals 265, 275.

In use, produced fluids from production well 230 exit as previously described via conduit 42 (not shown in FIG. 20), outlet 244 and tubing 232; the pressure of the fluids are boosted by booster pump 270. The produced fluids then pass into separator vessel 250, which separates the hydrocarbons from the sea water. The hydrocarbons are returned to production well cap 240 via tubing 233; from cap 240, they are then directed via the annulus surrounding the conduit 42 to export line 210.

The separated water is transferred via tubing 234 to the wellbore of injection well 330 via inlet 344. The separated water enters injection well through inlet 344, from where it passes directly into its conduit 42 and from there, into the production bore and the depths of injection well 330.

Optionally, it may also be desired to inject additional fluids into injection well 330. This can be done by closing a valve in tubing 234 to prevent any fluids from entering the injection well via tubing 234. Now, these additional fluids can enter injection well 330 via injection line 310 (which was formerly the export line in previous embodiments). The rest of this procedure will follow that described above with reference to FIG. 18. Fluids entering injection line 310 pass up the annulus between conduit 42 (see FIGS. 2 and 18) and the wellbore, are diverted by the seals 43 (see FIG. 2) at the lower end of conduit 42 to travel up the annulus, and exit via outlet 346. The fluids then pass along tubing 235, are pressure boosted by booster pump 260 and are returned via conduit 237 to inlet 344 of the christmas tree. From here, the fluids pass through the inside of conduit 42 and directly into the wellbore and the depths of the well 330.

Typically, fluids are injected into injection well 330 from tubing 234 (i.e. fluids separated from the produced fluids of production well 230) and from injection line 310 (i.e. any additional fluids) in sequence. Alternatively, tubings 234 and 237 could combine at inlet 344 and the two separate lines of injected fluids could be injected into well 330 simultaneously.

In the FIG. 20 embodiment, the processing apparatus could comprise simply the water separator vessel 250, and not include either of the booster pumps 260, 270.

Although only two connected wells are shown in FIGS. 19 and 20, it should be understood that more wells could also be connected to the respective processing apparatus.

Figure 21:
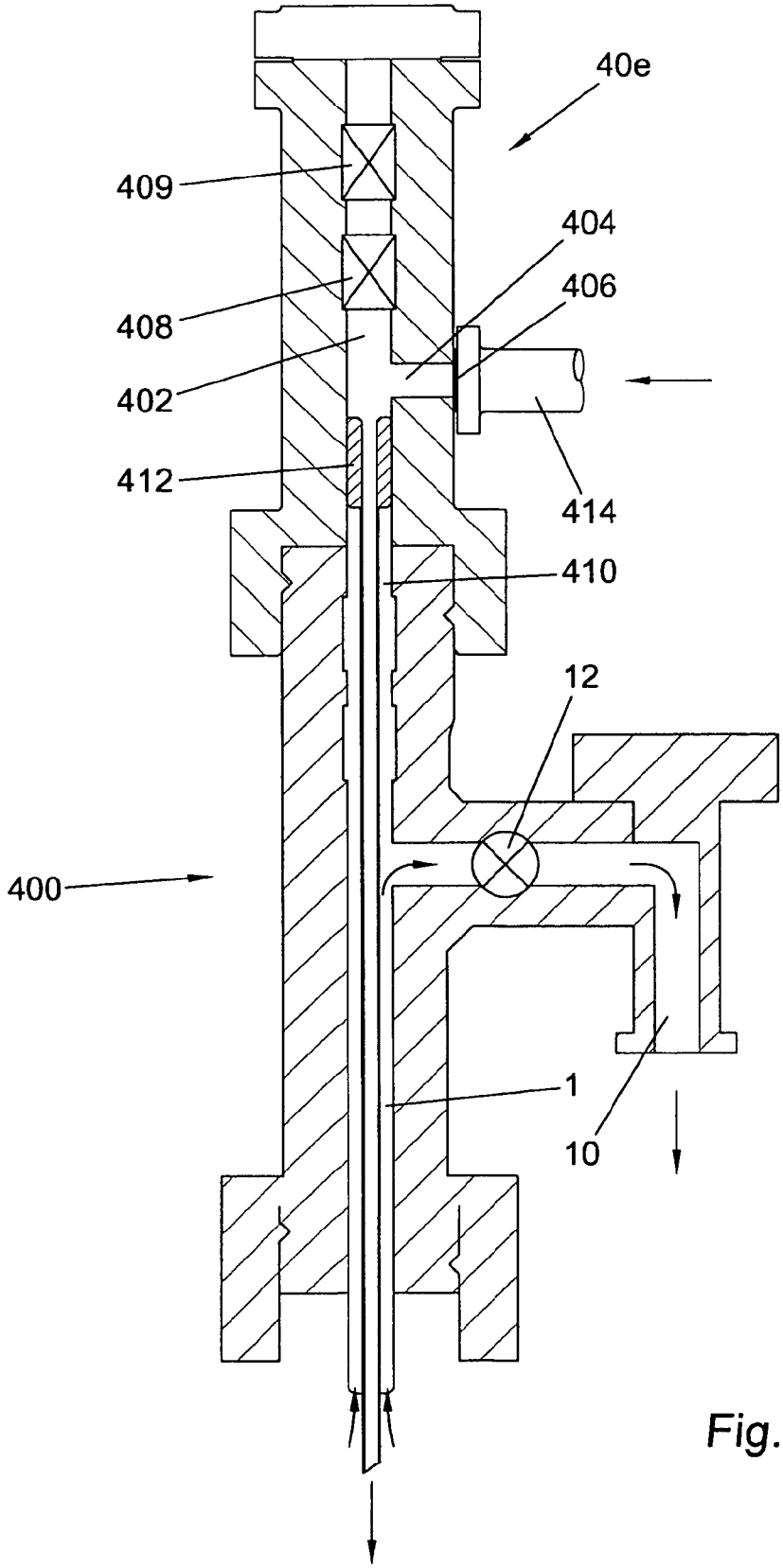
FIG. 21 shows a schematic diagram of a wellhead with a christmas tree cap having a gas injection line.

FIG. 21 shows an embodiment of the invention especially adapted for injecting gas into the produced fluids. A wellhead cap **40*e* is attached to the top of a horizontal tree 400. The wellhead cap 40*e* has plugs 408, 409; an inner axial passage 402; and an inner lateral passage 404, connecting the inner axial passage 402 with an inlet 406. One end of a coil tubing insert 410 is attached to the inner axial passage 402. Annular sealing plug 412 is provided to seal the annulus between the top end of coil tubing insert 410 and inner axial passage 402. Coil tubing insert 410 of 2 inch (5 cm) diameter extends downwards from annular sealing plug 412 into the production bore 1 of horizontal christmas tree 400**.

In use, inlet 406 is connected to a gas injection line 414. Gas is pumped from gas injection line 414 into christmas tree cap **40*e*, and is diverted by plug 408 down into coil tubing insert 410; the gas mixes with the production fluids in the well. The gas reduces the density of the produced fluids, giving them "lift". The mixture of oil well fluids and gas then travels up production bore 1, in the annulus between production bore 1 and coil tubing insert 410. This mixture is prevented from travelling into cap 40***e* by plug 408; instead it is diverted into branch 10 for recovery therefrom.

Figure 22:
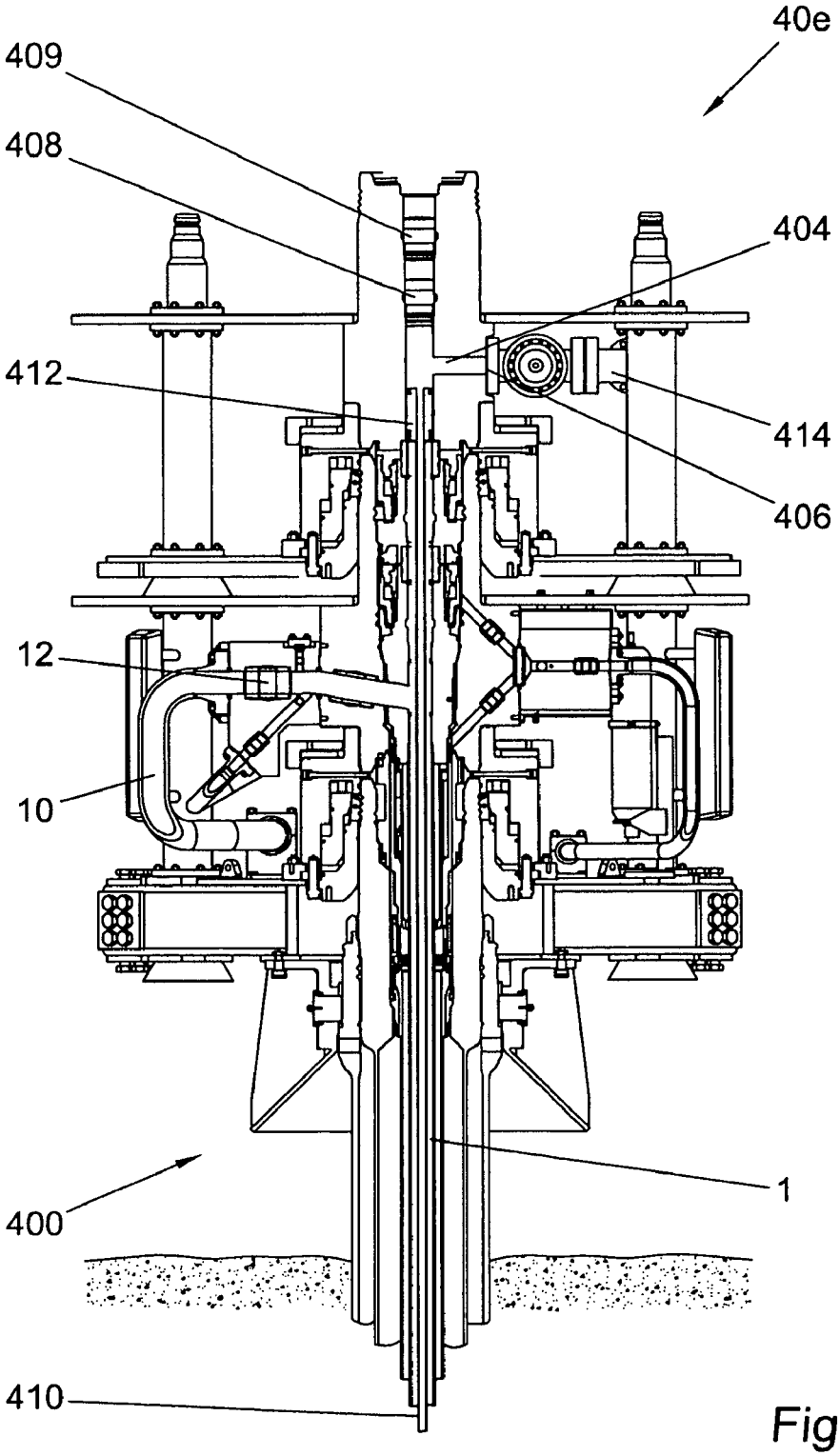
FIG. 22 shows a more detailed view of the apparatus of FIG. 21.

FIG. 22 shows a more detailed view of the FIG. 21 apparatus; the apparatus and the function are the same, and like parts are designated by like numbers.

Figure 23:
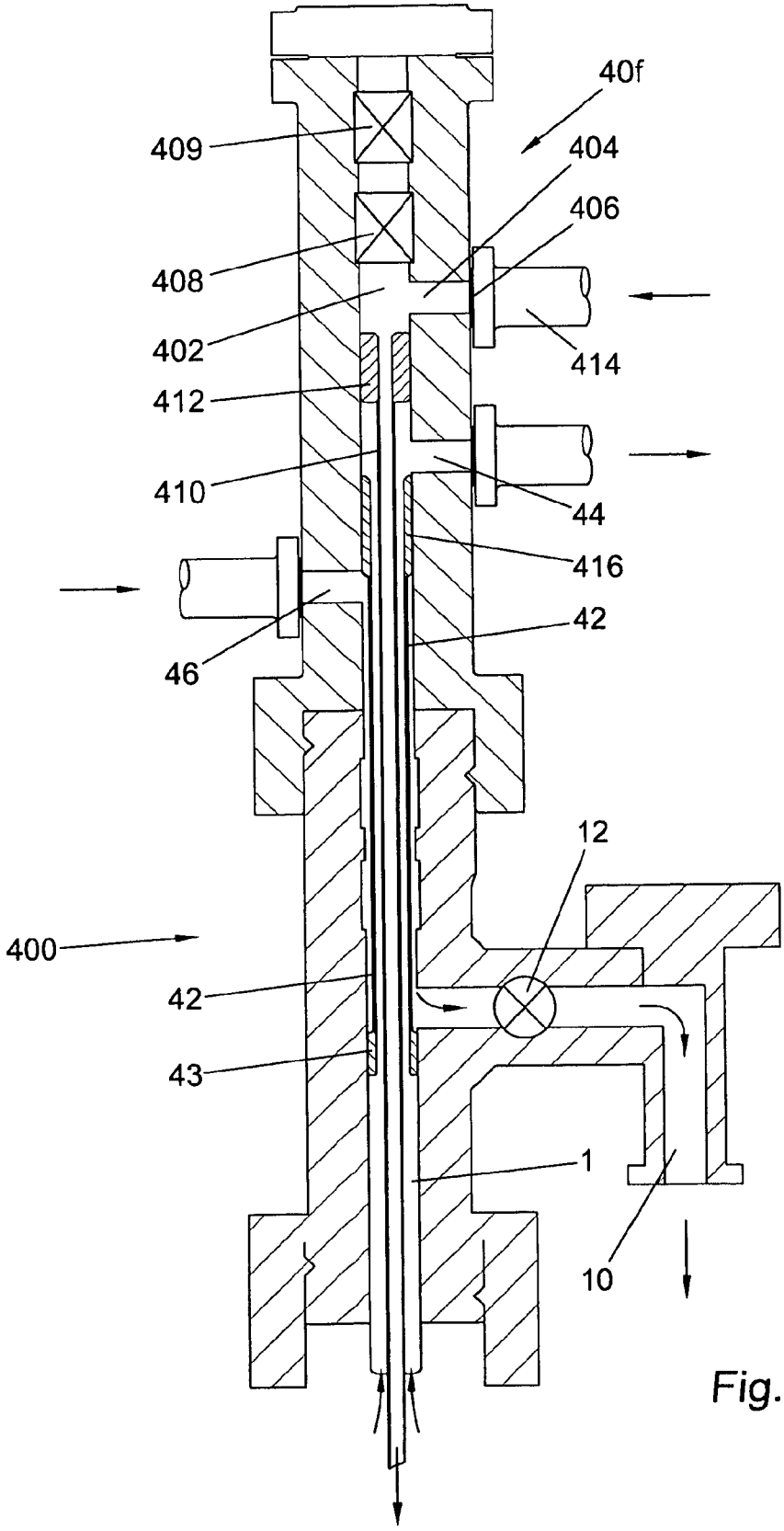
FIG. 23 shows a combination of the embodiments of FIGS. 2 and 21.

FIG. 23 shows the gas injection apparatus of FIG. 21 combined with the flow diverter assembly of FIG. 2 and like parts in these two drawings are designated here with like numbers. In this figure, outlet 44 and inlet 46 are also connected to inner axial passage 402 via respective inner lateral passages. A booster pump (not shown) is connected between outlet 44 and inlet 46. The top end of conduit 42 is sealingly connected at annular seal 416 to inner axial passage 402 above inlet 46 and below outlet 44. Annular sealing plug 412 of coil tubing insert 410 lies between outlet 44 and gas inlet 406.

In use, as in the FIG. 21 embodiment, gas is injected through inlet 406 into christmas tree cap 40*e* and is diverted by plug 408 and annular sealing plug 412 into coil tubing insert 410. The gas travels down the coil tubing insert 410, which extends into the depths of the well. The gas combines with the well fluids at the bottom of the wellbore, giving the fluids "lift" and making them easier to pump. The booster pump between the outlet 44 and the inlet 46 draws the "gassed" produced fluids up the annulus between the wall of production bore 1 and coil tubing insert 410. When the fluids reach conduit 42, they are diverted by seals 43 into the annulus between conduit 42 and coil tubing insert 410. The fluids are then diverted by annular sealing plug 412 through outlet 44, through the booster pump, and are returned through inlet 46. At this point, the fluids pass into the annulus created between the production bore/tree cap inner axial passage and conduit 42, in the volume bounded by seals 416 and 43. As the fluid cannot pass seals 416, 43, it is diverted out of the christmas tree through valve 12 and branch 10 for recovery.

Figure 24:
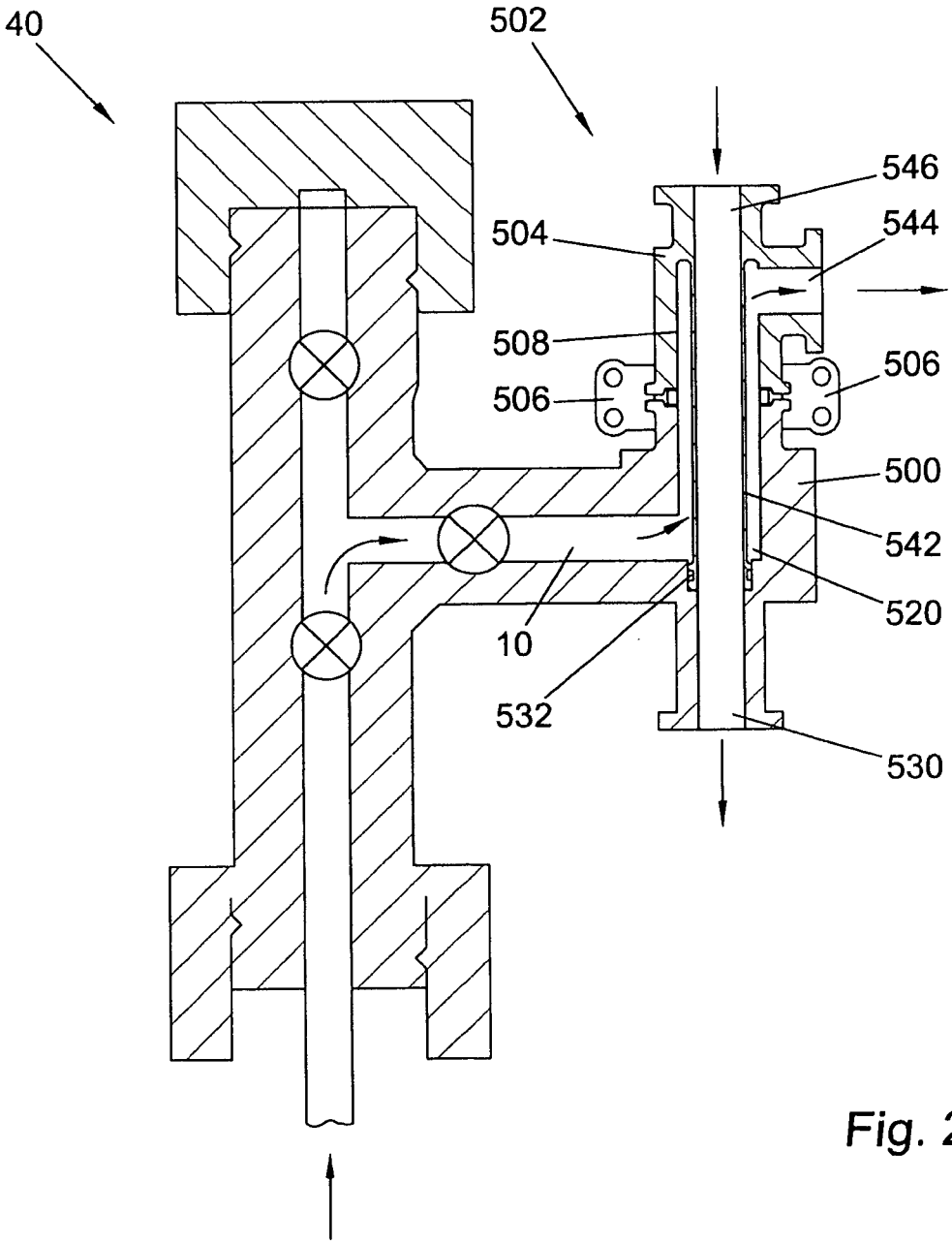
FIG. 24 shows a cross-section of an alternative embodiment, which has a diverter conduit located inside a choke body.
Figure 25:
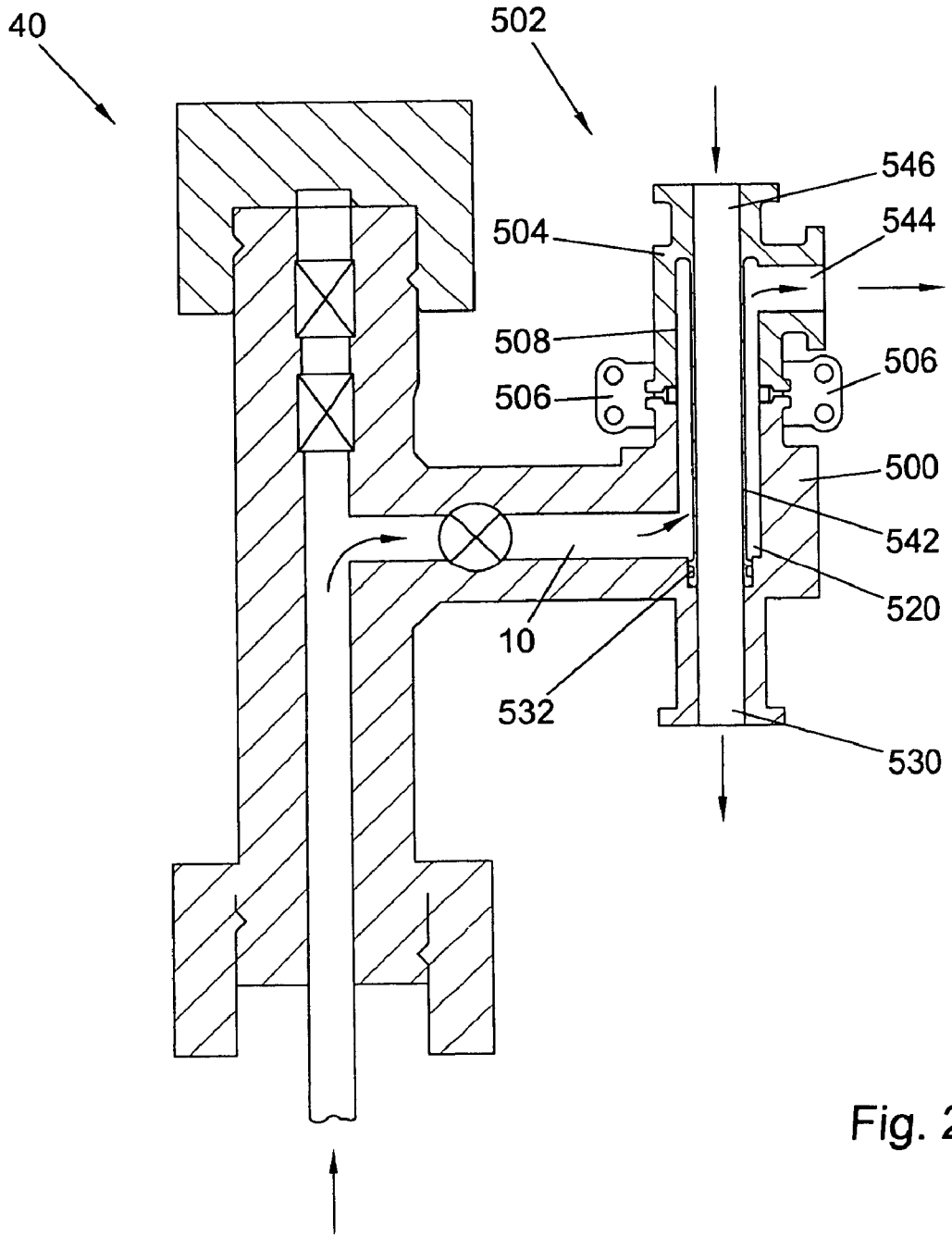
FIG. 25 shows a cross-section of the embodiment of FIG. 24 located in a horizontal tree.

Two further embodiments of the invention are shown in FIGS. 24 and 25; these embodiments are adapted for use in a traditional and horizontal tree respectively. These embodiments have a flow diverter assembly 502 located partially inside a christmas tree choke body 500. (The internal parts of the choke have been removed, just leaving choke body 500). Choke body 500 communicates with an interior bore of a perpendicular extension of branch 10.

Flow diverter assembly 502 comprises a housing 504, a conduit 542, an inlet 546 and an outlet 544. Housing 504 is substantially cylindrical and has an axial passage 508 extending along its entire length and a connecting lateral passage adjacent to its upper end; the lateral passage leads to outlet 544. The lower end of housing 504 is adapted to attach to the upper end of choke body 500 at clamp 506. Axial passage 508 has a reduced diameter portion at its upper end; conduit 542 is located inside axial passage 508 and extends through axial passage 508 as a continuation of the reduced diameter portion. The rest of axial passage 508 beyond the reduced diameter portion is of a larger diameter than conduit 542, creating an annulus 520 between the outside surface of conduit 542 and axial passage 508. Conduit 542 extends beyond housing 504 into choke body 500, and past the junction between branch 10 and its perpendicular extension. At this point, the perpendicular extension of branch 10 becomes an outlet 530 of branch 10; this is the same outlet as shown in the FIG. 2 embodiment. Conduit 542 is sealed to the perpendicular extension at seal 532 just below the junction. Outlet 544 and inlet 546 are typically attached to conduits (not shown) which leads to and from processing apparatus, which could be any of the processing apparatus described above with reference to previous embodiments.

In use, produced fluids come up the production bore 1, enter branch 10 and from there enter annulus 520 between conduit 542 and axial passage 508. The fluids are prevented from going downwards towards outlet 530 by seal 532, so they are forced upwards in annulus 520, exiting annulus 520 via outlet 544. Outlet 544 typically leads to a processing apparatus (which could be any of the ones described earlier, e.g. a pumping or injection apparatus). Once the fluids have been processed, they are returned through a further conduit (not shown) to inlet 546. From here, the fluids pass through the inside of conduit 542 and exit though outlet 530, from where they are recovered via an export line.

It is very common for christmas trees to have a choke; the FIG. 24 and FIG. 25 embodiments have the advantage that the flow diverter assembly can be integrated easily with the existing choke body with minimal intervention in the well; locating a part of the diverter assembly in the choke body need not even involve removing well cap 40.

Figure 26:
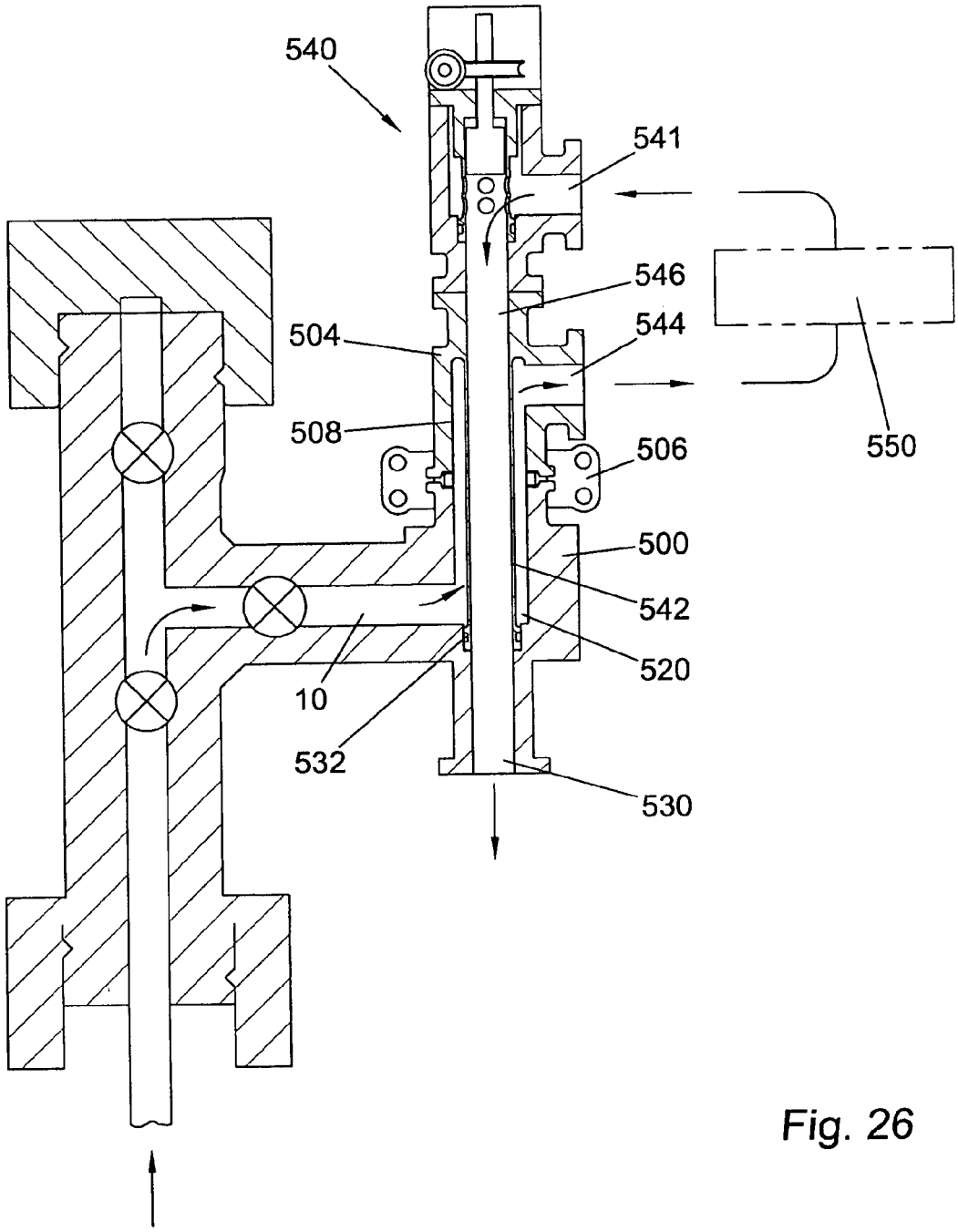
FIG. 26 shows a cross-section of a further embodiment, similar to the FIG. 24 embodiment, but also including a choke.

A further embodiment is shown in FIG. 26. This is very similar to the FIGS. 24 and 25 embodiments, with a choke 540 coupled (e.g. clamped) to the top of choke body 500. Like parts are designated with like reference numerals. Choke 540 is a standard subsea choke.

Outlet 544 is coupled via a conduit (not shown) to processing apparatus 550, which is in turn connected to an inlet of choke 540. Choke 540 is a standard choke, having an inner passage with an outlet at its lower end and an inlet 541. The lower end of passage 540 is aligned with inlet 546 of axial passage 508 of housing 504; thus the inner passage of choke 540 and axial passage 508 collectively form one combined axial passage.

In use, produced fluids from production bore 1 enter branch 10 and from there enter annulus 520 between conduit 542 and axial passage 508. The fluids are prevented from going downwards towards outlet 530 by seal 532, so they are forced upwards in annulus 520, exiting annulus 520 via outlet 544. Outlet 544 typically leads to a processing apparatus (which could be any of the ones described earlier, e.g. a pumping or injection apparatus). Once the fluids have been processed, they are returned through a further conduit (not shown) to the inlet 541 of choke 540. Choke 540 may be opened, or partially opened as desired to control the pressure of the produced fluids. The produced fluids pass through the inner passage of the choke, through conduit 542 and exit though outlet 530, from where they are recovered via an export line.

The FIG. 26 embodiment is useful for embodiments which also require a choke in addition to the flow diverter assembly of FIGS. 24 and 25.

Conduit 542 does not necessarily form an extension of axial passage 508. Alternative embodiments could include a conduit which is a separate component to housing 504; this conduit could be sealed to the upper end of axial passage 508 above outlet 544, in a similar way as conduit 542 is sealed at seal 532. Furthermore, flow diverter assembly 502 could be modified to resemble any of the assemblies shown in FIGS. 2 to 6.

Embodiments of the invention can be retrofitted to many different existing designs of wellhead tree, by simply matching the positions and shapes of the hydraulic control channels 3 in the cap, and providing flow diverting channels or connected to the cap which are matched in position (and preferably size) to the production, annulus and other bores in the tree. Therefore, the invention is not limited to the embodiments specifically described herein, but modifications and improvements can be made without departing from its scope.

What is claimed is:

1. A tree for a well, having: a first flowpath; a second flowpath; and a flow diverter assembly providing a flow diverter means to divert fluids from a first portion of a first flowpath to the second flowpath, and means to divert fluids returned from the second flowpath to a second portion of the first flowpath for recovery therefrom via an outlet of the first flowpath, wherein the first portion of the first flowpath, the second flowpath and the second portion of the first flowpath form a conduit for continuous passage of fluid; wherein the flow diverter assembly is located in the first flowpath and separates the first portion of the first flowpath from the second portion of the first flowpath.

2. The tree claimed in claim 1 comprising a tree cap housing at least a part of the flow diverter assembly.

3. The tree claimed in claim 1, including outlets for the first and second flowpaths to divert the production fluids to a treatment apparatus.

4. The tree claimed in claim 3, wherein the treatment apparatus is selected from the group consisting of pumping apparatus, injection apparatus, separation apparatus, chemical injection apparatus, and measurement apparatus.

5. The tree claimed in claim 1, wherein the flow diverter assembly comprises a conduit.

6. The tree claimed in claim 5, having a seal between the conduit and the wall of the first flowpath to prevent fluid from the first flowpath entering the annulus between the conduit and the first flowpath.

7. The tree claimed in claim 2, wherein the tree cap has fluid conduits for control of tree valves.

8. The tree claimed in claim 1, wherein the first flowpath comprises a production bore.

9. The tree claimed in claim 1, wherein the second flowpath comprises an annulus bore.

10. The tree claimed in claim 3, wherein the treatment apparatus comprises gas injection apparatus including a central gas injection line sealingly connected inside the tree and extending into the production bore.

11. A christmas tree having an outlet and flow diverter means to divert production fluids from a production bore via a second flowpath to treatment apparatus, and to return the fluids to the tree for recovery from the tree outlet.

12. A method of injecting fluids into a well having a christmas tree, the christmas tree having a first flowpath which has an inlet, and a second flowpath, the method comprising passing fluids into the christmas tree by the inlet of the first flowpath, diverting the fluids from a first portion of the first flowpath to the second flowpath and diverting the fluids from the second flowpath back to a second portion of the first flowpath.

13. The method claimed in claim 12, wherein the first flowpath is a production bore.

14. The method claimed in claim 12, wherein the second flowpath is an annulus bore.

15. The method claimed in claim 12, wherein a conduit is disposed in the first flowpath thereby creating an annulus between the first flowpath and the conduit, and wherein the fluids entering the inlet flow into the annulus and are subsequently returned through the conduit.

16. The method claimed in claim 15, wherein the bore of the conduit provides the second flowpath.

17. The method claimed in claim 15, wherein the conduit is sealed to the first flowpath across an outlet of the flowpath.

18. The method claimed in claim 12, wherein the second portion of the first flowpath is a lower part of the first flowpath proximate to the wellhead.

19. The method claimed in claim 12, wherein the fluids are diverted via a cap connected to the tree.

20. The method claimed in claim 19, wherein the fluids are diverted via the cap from the second flowpath to the second portion of the first flowpath.

21. The method claimed in claim 19, wherein the fluids are diverted via the cap from the first portion of the first flowpath to the second flowpath.

22. The method claimed in claim 12, wherein the fluids are diverted through a treatment apparatus connected between the first and second flowpaths, the treatment apparatus being selected from the group consisting of pumping apparatus, injection apparatus, separation apparatus, chemical injection apparatus and measurement apparatus.

23. The method claimed in claim 12, wherein the fluids are diverted through a crossover conduit between the first flowpath and the second flowpath.

24. A method of recovering and re-injecting production fluids from a first wellbore into a second wellbore, the first wellbore having a christmas tree, the christmas tree having a first flowpath which has an outlet and a second flowpath; the method comprising diverting fluid from a first portion of the first flowpath to the second flowpath, and diverting fluid from the second flowpath back to a second portion of the first flowpath; the method including the steps of processing the production fluids in a processing apparatus connected between the first and second flowpaths, and subsequently transferring a portion of the processed production fluids into the second wellbore.

25. The method claimed in claim 24, including the further step of returning a portion of the processed production fluids to the christmas tree of the first wellbore and thereafter recovering that portion of the production fluids from the outlet of the first flowpath.

26. The method claimed in claim 24, wherein the processing apparatus is selected from the group consisting of pumping apparatus, injection apparatus, separation apparatus, chemical injection apparatus and measurement apparatus.

27. The method claimed in claim 24, wherein the processing apparatus comprises separating apparatus and the method includes the step of separating a water component from the rest of the production fluids, and the step of transferring the water component to the second wellbore and returning the rest of the produced fluids to the christmas tree of the first wellbore for recovery therefrom.

28. The method claimed in claim 24, wherein the second wellbore is provided with a christmas tree having a first flowpath which has an inlet, and a second flowpath; and the method includes the step of passing fluids into the christmas tree of the second wellbore by the inlet of the first flowpath, diverting the fluids from a first portion of the first flowpath to the second flowpath and diverting the fluids from the second flowpath back to a second portion of the first flowpath.

* * * * *